US012692677B1

(12) United States Patent
Erickson

(10) Patent No.: US 12,692,677 B1
(45) Date of Patent: Jul. 28, 2026

(54) DROP HAMMER SYSTEMS AND METHODS FOR DRIVING ELONGATE MEMBERS INTO THE EARTH

(71) Applicant: Gordon J. Erickson, Victoria (CA)

(72) Inventor: Gordon J. Erickson, Victoria (CA)

(73) Assignee: Gordon J. Erickson, Victoria (CA)

( * ) Notice: Subject to any disclaimer, the term of this patent is extended or adjusted under 35 U.S.C. 154(b) by 70 days.

(21) Appl. No.: 18/824,666

(22) Filed: Sep. 4, 2024

Related U.S. Application Data

(60) Provisional application No. 63/664,370, filed on Jun. 26, 2024.

(51) Int. Cl.
*E02D 7/08* (2006.01)
*E02D 7/14* (2006.01)

(52) U.S. Cl.
CPC ..... *E02D 7/08* (2013.01); *E02D 7/14* (2013.01)

(58) Field of Classification Search
CPC ..... E02D 7/08; E02D 7/14
See application file for complete search history.

(56) References Cited

U.S. PATENT DOCUMENTS 1,810,536 A * 6/1931 Scism ..... B21J 13/00 248/591
1,995,441 A 3/1935 Urschel
2,142,112 A * 1/1939 Criley ..... B21J 7/36 72/439
2,792,689 A 5/1957 Phares
2,869,824 A 1/1959 Hazak
2,952,132 A 9/1960 Urban
3,743,030 A 7/1973 Gifford
4,076,081 A * 2/1978 Schnell ..... E02D 7/125 173/132
4,204,420 A 5/1980 Rogers et al.
(Continued)

FOREIGN PATENT DOCUMENTS

AU 5186800 A * 2/2001
CN 108252304 A 7/2018
(Continued)

OTHER PUBLICATIONS

Bruce Video, Bruce Piling Equipment, Introduction of BRUCE Piling Equipment-Pile Hammer-Vibratory Hammer, https://www.youtube.com/watch?v=hDUgCby0stl, 2 pages.
(Continued)

*Primary Examiner* — Kyle Armstrong
(74) *Attorney, Agent, or Firm* — Schacht Law Office, Inc.; Michael R. Schacht; Bronte Brillantes

(57) ABSTRACT

A drop hammer pile driving system comprising a housing assembly comprising a housing member and a drop plate assembly, a hammer member, and a drive system. The drive system comprises a first drive wheel assembly comprising a first drive wheel and a motor and a second drive wheel assembly comprising a second drive wheel and an actuator assembly. The actuator assembly displaces the second drive wheel between first and second positions. When the pile upper end is at an engaging location and the drive wheel is in the second position, operation of the motor rotates the first drive wheel such that the first and second drive wheels engage the hammer member to lift the hammer member relative to the housing member.

18 Claims, 22 Drawing Sheets

(56) References Cited

U.S. PATENT DOCUMENTS

| | | | | |
|---|---|---|---|---|
| 4,262,755 | A | 4/1981 | Kuhn | |
| 4,340,210 | A | 7/1982 | Townsend | |
| 4,405,020 | A | 9/1983 | Rassieur | |
| 4,421,180 | A * | 12/1983 | Fleishman | E02D 7/08 173/132 |
| 4,993,500 | A * | 2/1991 | Greene | E02D 1/025 173/124 |
| 5,811,741 | A | 9/1998 | Coast et al. | |
| 6,257,352 | B1 | 7/2001 | Nelson | |
| 7,387,173 | B2 | 6/2008 | Jinnings et al. | |
| 7,686,098 | B2 * | 3/2010 | Tyer | E21B 1/02 173/90 |
| 8,763,719 | B2 * | 7/2014 | White | E02D 7/125 173/132 |

FOREIGN PATENT DOCUMENTS

| | | | |
|---|---|---|---|
| DE | 1950118 | A1 | 4/1971 |
| NZ | 506169 | A | 10/2001 |
| WO | 2023110036 | A1 | 6/2023 |

OTHER PUBLICATIONS

Bruce Website, Bruce Piling Equipment, Hydraulic Pile Hammer BRUCE Piling Equipment, https://www.powerquip.co.kr/products/hydraulic-pile-hammer/features, 5 pages.

* cited by examiner

DROP HAMMER SYSTEMS AND METHODS FOR DRIVING ELONGATE MEMBERS INTO THE EARTH

RELATED APPLICATIONS

This application claims benefit of U.S. Provisional Application Ser. No. 63/664,370 filed Jun. 26, 2024, the contents of which are incorporated herein by reference.

TECHNICAL FIELD

The present invention relates to pile driving systems and methods and, in particular, to pile driving systems and methods that raise and drop a hammer member to drive an elongate member such as a pile into the earth.

BACKGROUND

Pile driving systems are often used to drive elongate members such as solid piles, pipe piles, caissons, and the like into the earth. Pile driving systems can use a number of methods to apply a driving force to the pile, including one or more of rotational forces, vibrational forces, and impact forces (hammer).

The present invention relates to a class of pile drivers that raise a heavy weighted hammer member and then drop the hammer member onto the elongate member to apply a driving force along the longitudinal axis of the pile. This type of pile driving system may be referred to as a drop hammer, and the invention will be described herein in the context of a drop hammer pile driving system.

The hammer member of a drop hammer pile driving system can be raised and dropped using any number of lift systems. One type of lift system employs at least one rotating drive wheel support on a housing to frictionally engages the hammer member such that rotation of the wheel causes linear upward displacement of the hammer member relative to the housing. With the housing in a desired orientation relative to the elongate member, releasing the frictional forces applied to the hammer member by the wheel allows the hammer member to drop and apply a driving, impact force on the elongate member to be driven.

SUMMARY

The present invention may be embodied as a drop hammer pile driving system comprising a housing assembly comprising a housing member and a drop plate assembly, a hammer member, and a drive system. The drive system comprises a first drive wheel assembly comprising a first drive wheel and a motor and a second drive wheel assembly comprising a second drive wheel and an actuator assembly. The actuator assembly displaces the second drive wheel between first and second positions. When the pile upper end is at an engaging location and the drive wheel is in the second position, operation of the motor rotates the first drive wheel such that the first and second drive wheels engage the hammer member to lift the hammer member relative to the housing member.

The present invention may also be embodied as a drop hammer pile driving system for driving a pile defining a pile upper end, the drop hammer pile driving system comprising a housing assembly, a hammer member, and a drive system. The housing assembly comprises a housing member and a drop plate assembly. The housing member defines a housing chamber, a pile opening, at least one plate slot, at least one first drive slot, and at least one second drive slot. The at least one first drive slot and the at least one second drive slot define an engaging location relative to the housing assembly. At least a portion of the drop plate assembly is arranged within the housing chamber. At least a portion of the drop plate assembly is arranged within the at least one plate slot to limit movement of the drop plate assembly relative to the housing member. The hammer member is arranged within the housing chamber for movement relative to the housing member and the drop plate assembly. The drive system comprises first and second drive wheel assemblies. The first drive wheel assembly comprises at least one first drive wheel and a drive motor, where the at least one first drive wheel is arranged to extend into the at least one first drive slot. The second drive wheel assembly at least one second drive wheel and an actuator assembly, where the actuator assembly is arranged and configured to displace the at least one second drive wheel between a first position in which the at least one second drive wheel does not extend through the at least one second drive slot and a second position in which in which at least a portion of the at least one second drive wheel extends through the at least one second drive slot into the housing chamber. With the pile upper end within the housing chamber, the drop plate assembly is arranged between the pile upper end and the hammer member. The engaging location is arranged relative to the drop plate assembly such that, when the pile upper end a first distance within the housing chamber and the drive wheel is in the second position, the pile upper end is below the engaging location and, when the pile upper end a second distance within the housing chamber, the pile upper end is at the engaging location. When the pile upper end is at the engaging location and the drive wheel is in the second position, operation of the motor rotates the first drive wheel such that the first and second drive wheels engage the hammer member to lift the hammer member relative to the housing member.

DETAILED DESCRIPTION

The present invention may be embodied in a number of different forms, and several examples of the present invention will be described below. In the following detail descriptions, directional terms such as "upper", "lower", "top", "bottom", "lateral", and the like assume that the example drop hammer pile driving systems of the present invention are upright as they are typically configured during normal use.

I. First Example Drop Hammer Pile Driving System

Figure 1:
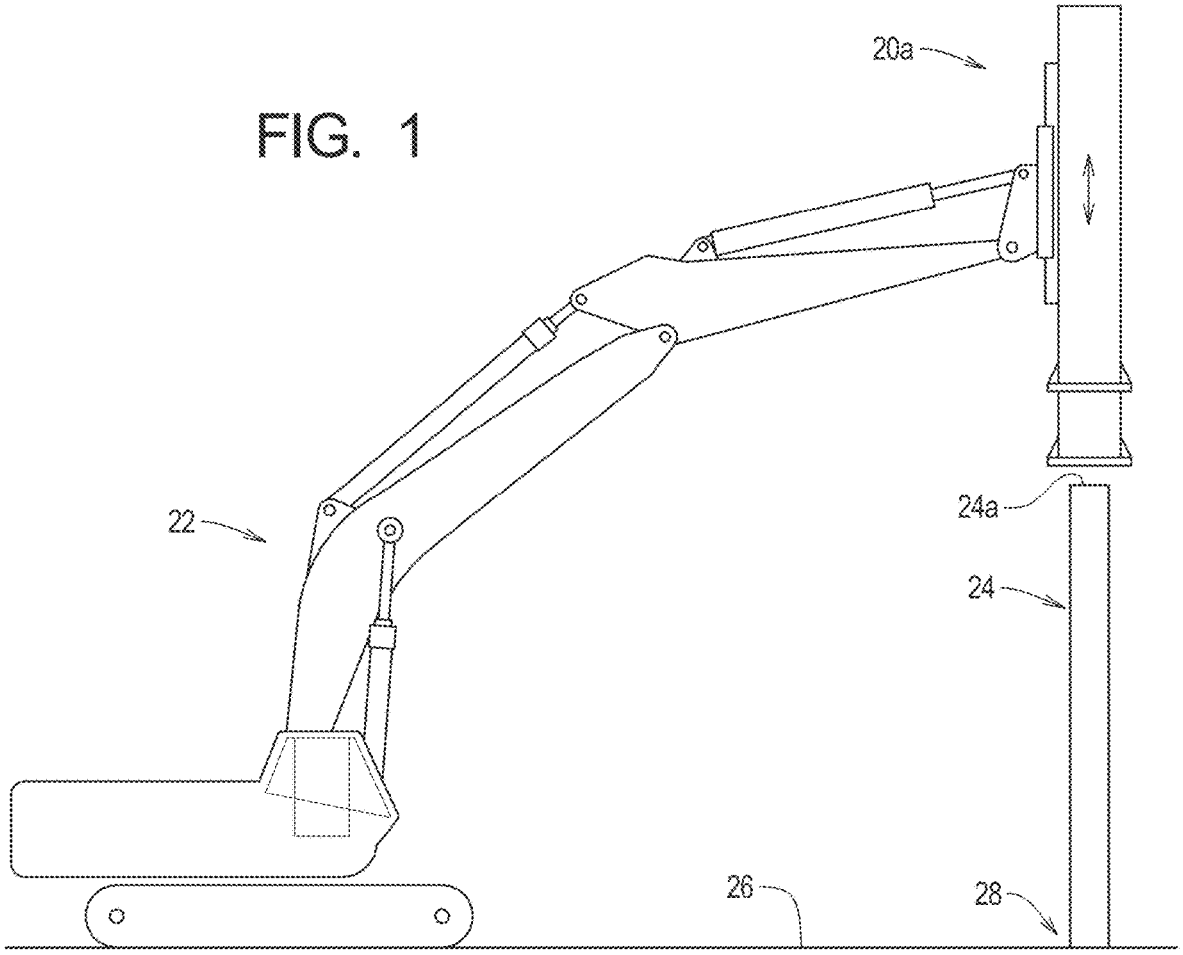
FIG. 1 is a side elevation view of a pile driving system comprising a first example drop hammer pile driving system supported to drive an elongate member or pile into the earth.

Referring initially to FIGS. 1-12 of the drawing depicted therein is a first example drop hammer pile driving system 20*a* constructed in accordance with, and embodying, the principles of the present invention. In FIG. 1, the first example drop hammer pile driving system 20*a* is supported by a support system 22 to drive a pile 24 into the earth 26 at a desired location 28 and in a desired orientation (e.g., substantially vertical). The example support system 22 is an excavator, but other support systems may be used in addition to or instead of the excavator as depicted. The example support system 22 and pile 24 are not per se part of the invention and will be described herein only to that extent helpful to a complete understanding of the construction and operation of the present invention.

FIGS. 2-5 of the drawing illustrate that the first example drop hammer pile driving system 20*a* comprises a housing assembly 120*a*, a hammer member 122*a*, and a drive system 124*a*. As shown in FIGS. 6-13, the example housing assembly 120*a* and the example hammer member 122*a* are sized, dimensioned, and located relative to each other such that, when the first example drop hammer pile driving system 20*a* is not operatively engaged with the pile 24, gravity displaces the hammer member 122*a* relative to the housing assembly 120*a* such that the hammer member 122*a* cannot engage the drive system 124. However, when the first example drop hammer pile driving system 20*a* is operatively engaged with the pile 24, gravity and/or the support system 22 may displace the housing assembly 120*a* down relative to the hammer member 122*a* such that the hammer member 122*a* eventually engages the drive system 124. When the hammer member 122*a* engages the drive system 124, operation of the drive system 124 may lift and drop the hammer member 122*a* along a drive axis AD relative to the pile 24.

Accordingly, with the first example drop hammer pile driving system 20*a* engaged with the pile 24, repeated lifting and dropping of the hammer member 122*a* along the drive axis AD may be used to drive the pile 24 into the earth 26 at the desired location 28. But when with the first example drop hammer pile driving system 20*a* is disengaged from the pile 24, the drive system 124 is not able to displace the hammer member 122*a* relative to the housing assembly 120*a*.

With the foregoing general understanding of the present invention in mind, the details of the construction and operation of the first example drop hammer pile driving system 20*a* will now be described in further detail.

Referring again back to FIGS. 2-5, it can be seen that the example housing assembly 120*a* comprises a housing member 130, a drop plate assembly 132, a first brace plate 134, a second brace plate 136, and stop bumpers 138. The example housing member 130 defines a housing chamber 140, a pile opening 142, one or more plate slots 144, one or more first drive slots 146, and one or more second drive slots 148. The example drop plate assembly 132 comprises a drop plate 150, one or more hammer bumpers 152, and one or more housing bumpers 154. The example drop plate 150 defines an impact portion 160, one or more guide portions 162, and one or more guide spaces 164.

The example hammer member 122*a* defines an upper end 126 and a lower end 128 and is sized and dimensioned to be received within the housing chamber 140 for movement along a housing axis A1 relative to the housing member 130. The housing axis A1 is substantially aligned with the drive axis AD associated with the first example drop hammer pile driving system 20*a*. A hammer axis A2 of the hammer member 122*a* is generally, but typically not exactly, aligned with the housing axis A1 during normal operation of the first example drop hammer system 20*a* during.

FIGS. 2, 4, and 6-13 illustrate that the example drive system 124 comprises a first drive wheel assembly 170 and a second drive wheel assembly 172.

The example first drive wheel assembly 170 comprises at least one first drive wheel 180, at least one first drive wheel axle/motor assembly 182, and one or more (typically two) first drive wheel support bracket(s) 184. The example first drive wheel support bracket(s) 184 support the first drive wheel axle(s) 182 in a fixed relation to the housing assembly 120*a*. The first drive wheel axle(s) 182 rotatably support(s) the first drive wheel(s) 180 such that the first drive wheel(s) 180 may rotate about an axis of the first drive wheel axle(s) and such that the first drive wheel(s) 180 extend(s) at least partly into the housing chamber 140 through the first drive slot(s) 146. The example first drive motor assembly(ies) 186 are arranged to rotate the first drive wheel(s) 180 about the axis of the first drive wheel axle(s) 182.

Figure 6:
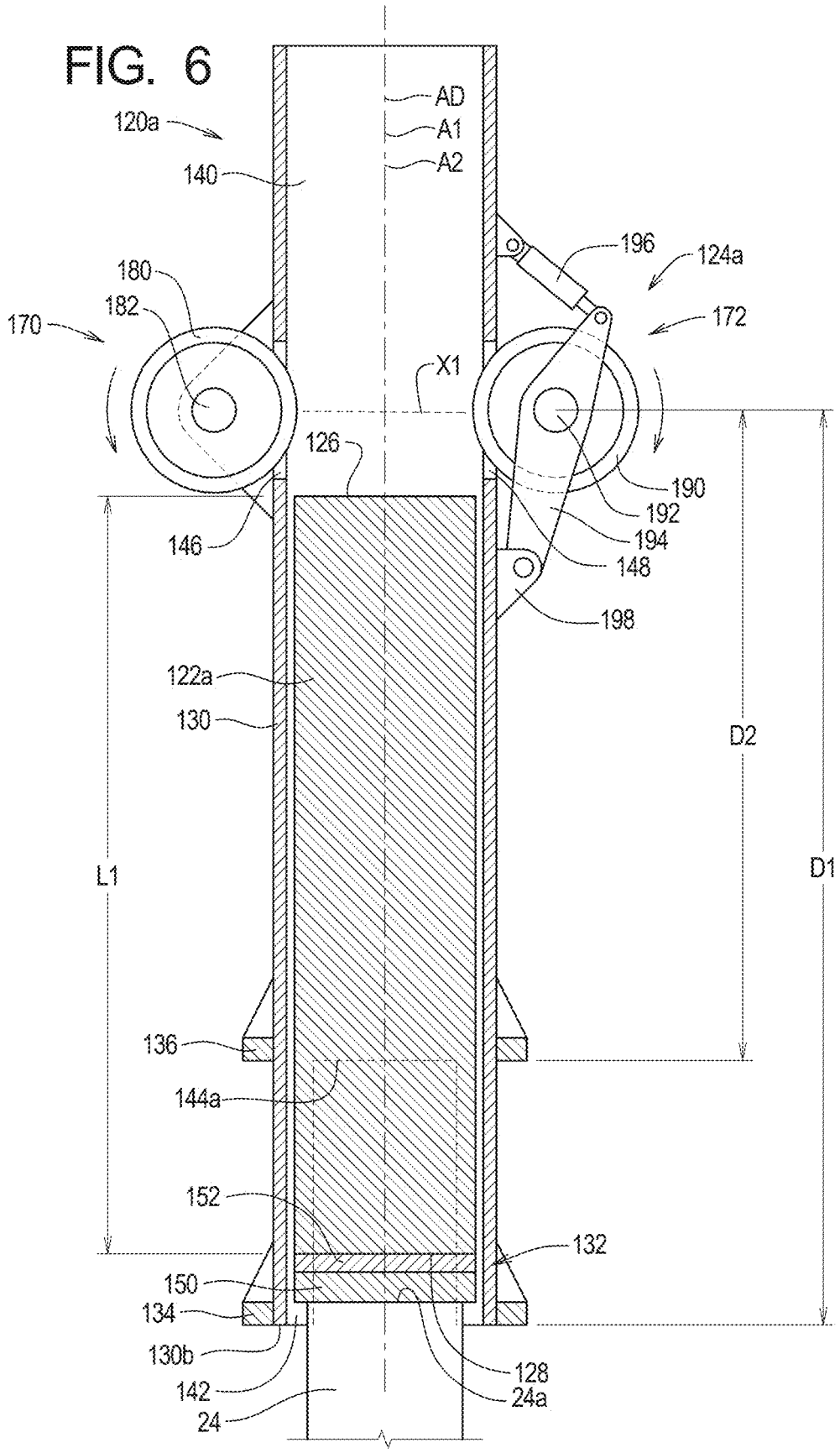
FIG. 6 is a front section view of the first example drop hammer pile driving system taken along lines 6-6 in FIG. 4, where the hammer member is in the initial pile engagement position relative to the housing assembly and the drive system is in a first configuration.

The example second drive wheel assembly 172 comprises at least one second drive wheel 190, at least one second drive wheel motor/axle assembly 192, at least one second drive wheel pivot arm 194, at least one second drive wheel pivot arm actuator assembly 196, and one or more (typically two) second drive wheel support bracket(s) 198. The example second drive wheel support bracket(s) 198 support the second drive wheel pivot arm 194 for pivoting movement about a pivot axis defined by the second drive wheel support bracket(s) 198. The second drive wheel pivot arm 194 supports the second drive wheel motor/axle assembly 192, and the second drive wheel motor/axle assembly 192 supports the second drive wheel 190 for rotation about the axis of the second drive wheel motor/axle assembly 192. The second drive wheel pivot arm actuator assembly 196 is connected between the housing member 130 and the second drive wheel pivot arm 194 such that operation of the actuator assembly 196 between first (e.g., retracted; FIGS. 6, 9 and 13) and second (e.g., extended; FIGS. 2, 10, 11 and 12) configurations pivots the second drive wheel pivot arm 194 between first (FIGS. 6-9) and second (FIGS. 2, 10, and 11) pivot arm positions relative to the housing member 130. In the first position, the second drive wheel 190 extends partly into the housing chamber 140 through the second drive slot 148. In the second position, the second drive wheel 190 does not extend into the housing chamber 140 through the second drive slot 148. The example first drive motor assembly(ies) 192 are arranged to rotate the second drive wheel(s) 192.

The distances between the first drive wheel 180 and the second drive wheel 190 in the first and second positions are predetermined based on dimensions of the hammer member 122*a*. In particular, when the second drive wheel 190 is in the first position, the second drive wheel 190 extends into the housing chamber 140 through the second drive slot 148 such that the distance between the first and second drive wheels 180 and 190 causes the first and second drive wheels 180 and 190 both to frictionally engage the hammer member 122*a*. When the second drive wheel 190 is in the second position, the second drive wheel 190 does not extend into the housing chamber 140 through the second drive slot 148, and at least the second drive wheel 190 is disengaged from the hammer member 122*a*.

Accordingly, operation of the actuator assembly 196 in the retracted position places the second drive wheel 190 in the first position such that the first and second drive wheels frictionally engage the hammer member 122*a*. When the first and second drive wheels 180 and 190 are both in frictional engagement with the hammer member 122*a*, operation of the drive wheel axle/motor assembly 182 results in rotation of the first drive wheel 180, which in turn causes movement of the hammer member 122*a* along the drive axis AD. The example drive system 124*a* is in a first configuration when the second drive wheel 190 is in the first position. However, operation of the actuator assembly 196 in the extended position places the second drive wheel 190 in the second position such that the first drive wheel 180 does not engage the hammer member 122*a* with sufficient friction to displace the hammer member 122*a* relative to the housing assembly 120*a*. The example drive system 124*a* is in a second configuration when the second drive wheel 190 is in the second position.

When the second drive wheel 190 is in the first position (i.e., the first and second drive wheels 180 and 190 are both in frictional engagement with the hammer member 122*a*), operation of the drive wheel axle/motor assembly 182 results in rotation of the first drive wheel 180, which in turn causes movement of the hammer member 122*a* along the drive axis AD. When the second drive wheel 190 is in the second position (i.e., the first drive wheel 180 is not capable of engaging the hammer member 122*a* such that the hammer member 122*a* is displaced relative to the housing assembly 120*a*), operation of the drive wheel axle/motor assembly 182 does not cause linear movement of the hammer member 122*a* along the drive axis AD.

Figure 4:
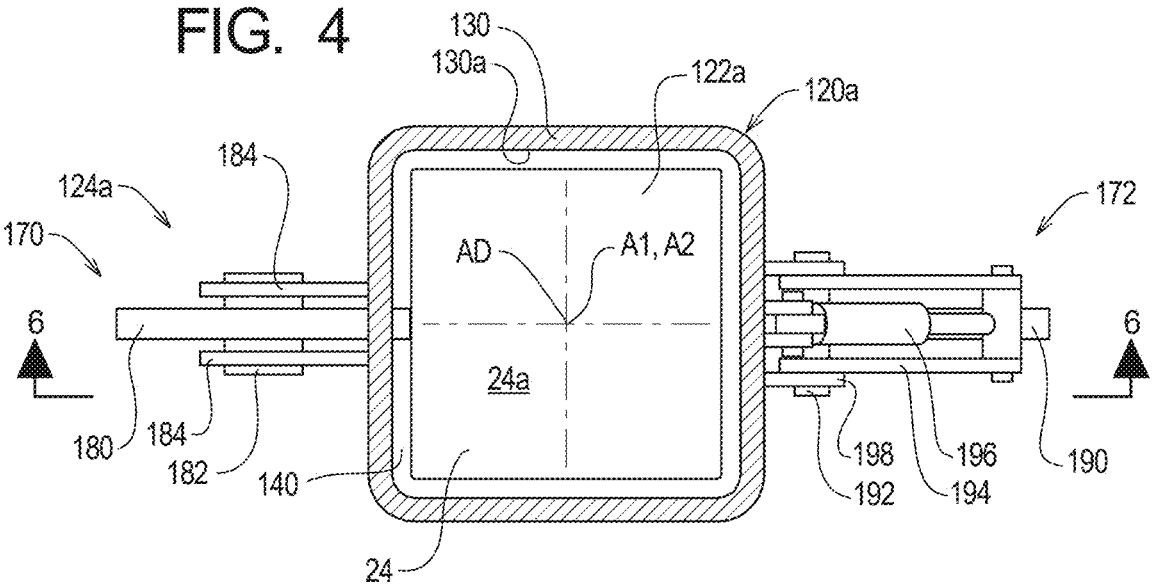
FIG. 4 is a section view of the first example drop hammer pile driving system taken along lines 4-4 in FIG. 2.

An inner surface 130*a* of the housing member 130 defines a perimeter cross-section area as perhaps best shown in FIG. 4 of the drawing. The example perimeter cross-section defined by the example housing member 130 is generally rectangular or square. When the example second drive wheel 190 is in the first position relative to the housing member 130, the closest points on first and second drive wheels 180 and 190 define an engaging location X1 associated with the example drive system 124*a*. A first spacing distance D1 is defined as a distance between the engaging location X1 and a bottom edge 130*b* defined by the housing member 130. A second spacing distance D2 is defined as a distance between the engaging location X1 and a top slot edge 144*a* defined by the plate slot(s) 144.

The example hammer member 122*a* defines a perimeter cross-sectional area and a length L1. As shown in FIG. 4, a perimeter cross-sectional area of the example hammer member 122*a* is similar to, but slightly smaller than, the perimeter cross-sectional area defined by the inner surface 130*a* of the housing member 130.

In the first example drop hammer pile driving system 20*a*, the length L1 of the hammer member 122*a* is predetermined with respect to the first and second spacing distances D1 and D2 defined relative to the housing member 130 and an effective thickness TD of the drop plate assembly 132. The effective thickness TD of the drop plate assembly 132 is the sum of the thicknesses of the stop bumpers 138, the drop plate 150, and the housing bumpers 154 as perhaps best shown in FIG. 8A.

Figure 2:
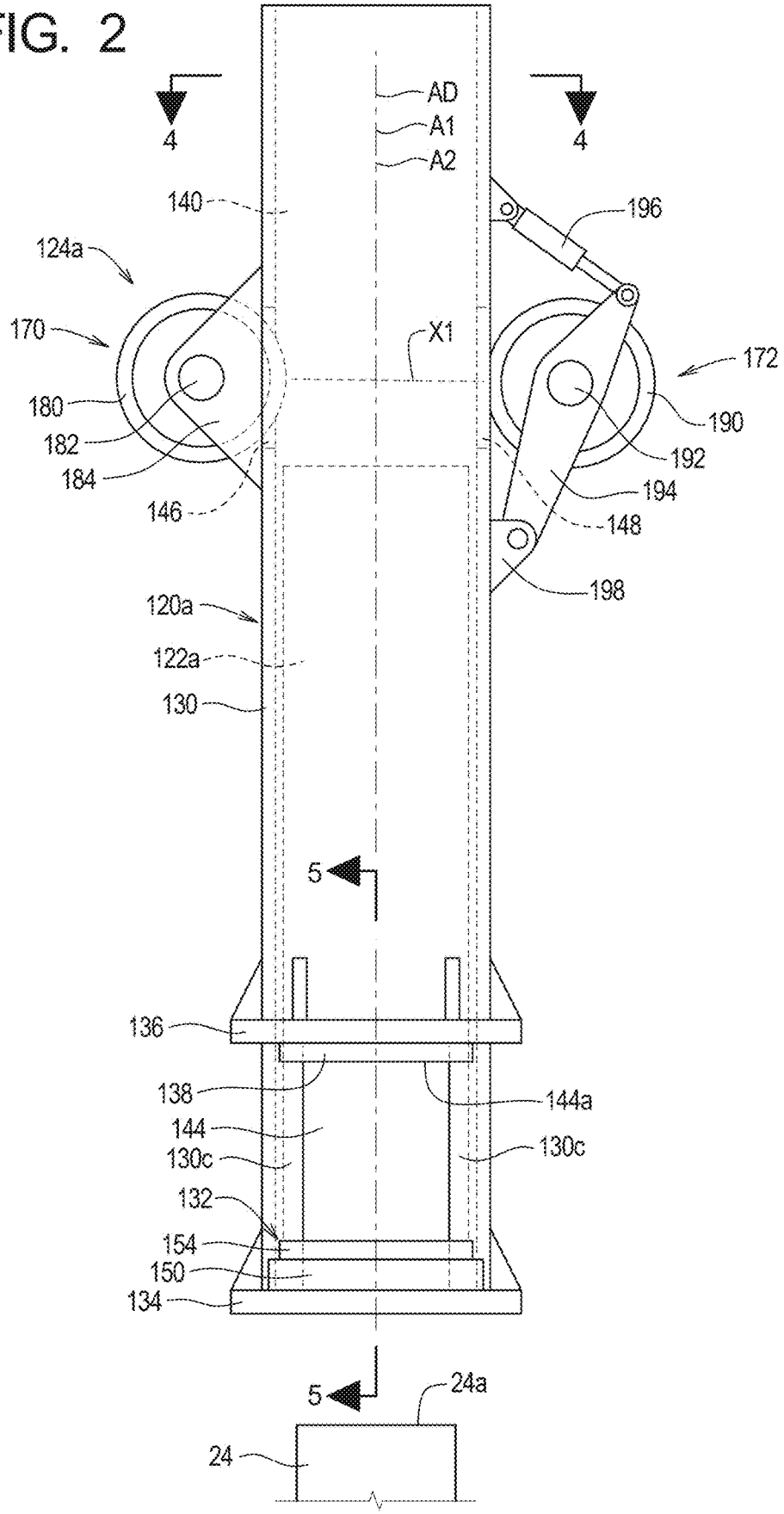
FIG. 2 is a side elevation view of the first example pile driving system illustrating a hammer member in a first hammer position relative to a housing assembly and a drive system in a second configuration.
Figure 5:
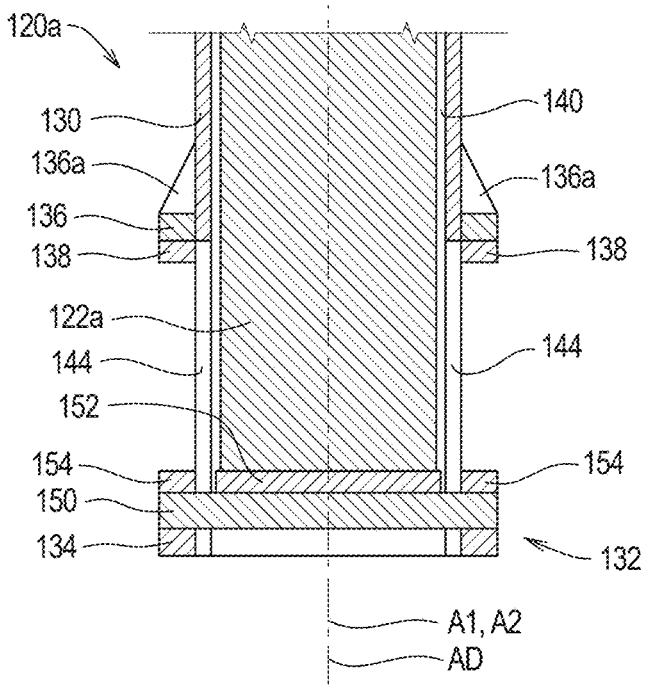
FIG. 5 is a section view of the first example drop hammer pile driving system taken along lines 5-5 in FIG. 2.

More specifically, the length L1 of the hammer member 122*a* is such that, when the first example drop hammer pile driving system 20*a* is suspended by the support system 22 in a generally vertical orientation and disengaged from the pile 24, the entire hammer member 122*a* is located below the first and second drive slots 146 and 148 and, more specifically, below the engaging location X1 defined by the first drive wheel 180 and the second drive wheel 190 in the first position (FIGS. 2, 5, and 6). Accordingly, so long as the first example drop hammer pile driving system 20*a* is suspended by the support system 22 in a substantially vertical orientation and disengaged from the pile 24, the drive system 124*a* will not engage the hammer member 122*a* and the hammer member 122*a* is not displaced relative to the housing assembly 120*a*.

Figure 6A:
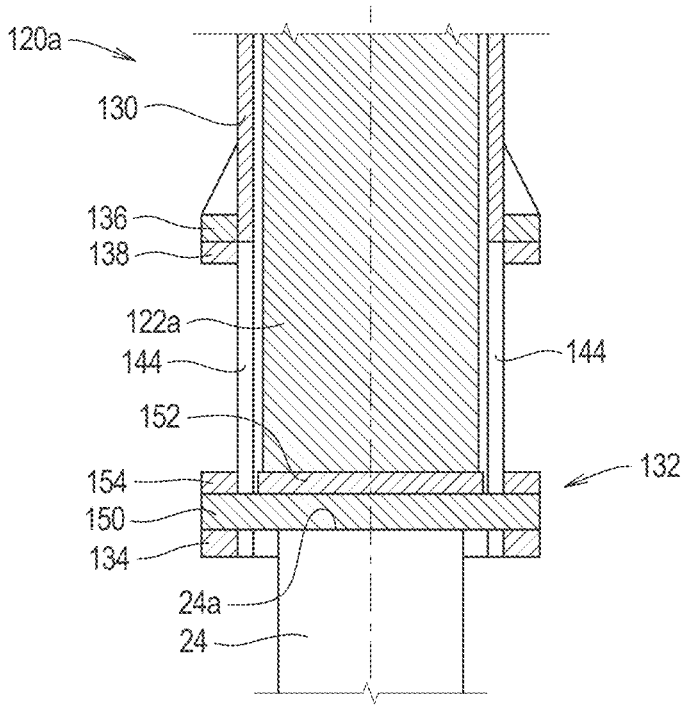
FIG. 6A is a side section view of the first example drop hammer pile driving system as depicted in FIG. 6.

When support system 22 supports the first example drop hammer pile driving system 20*a* and the drop plate assembly 132 comes into contact with the pile 24 as shown in FIGS. 6 and 6A, the drive system 124*a* does not engage hammer member 122*a* even if the second drive wheel 190 is in the first position as shown. At this point, the drop plate assembly 132 rests on the pile 24 and lower end 128 of the hammer member 122*a* rests on hammer bumper 152 of the drop plate assembly 132.

Figure 7:
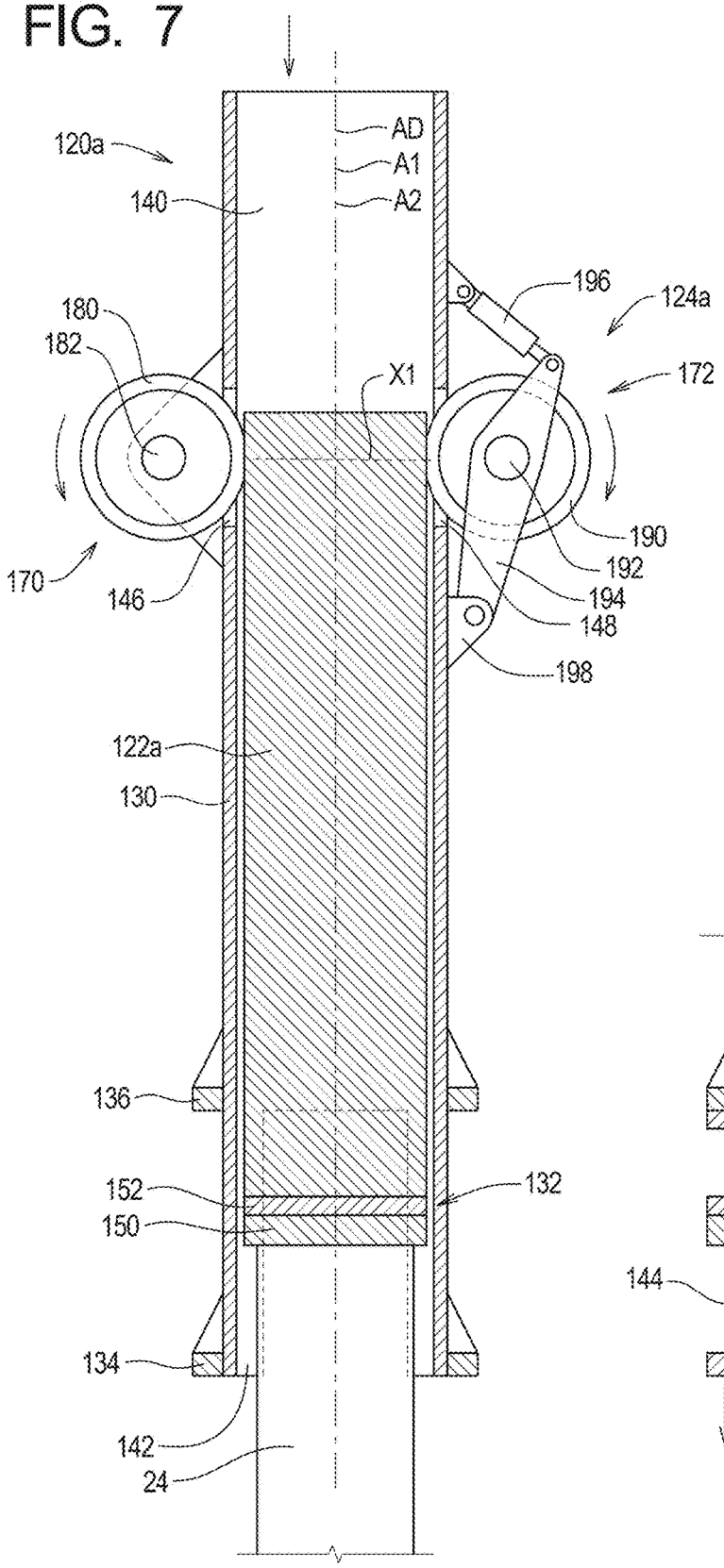
FIG. 7 is a front section view of the first example drop hammer pile driving system similar to FIG. 6, where the hammer member is in an initial drive system engagement position relative to the housing assembly and the drive system is in the first configuration.
Figure 7A:
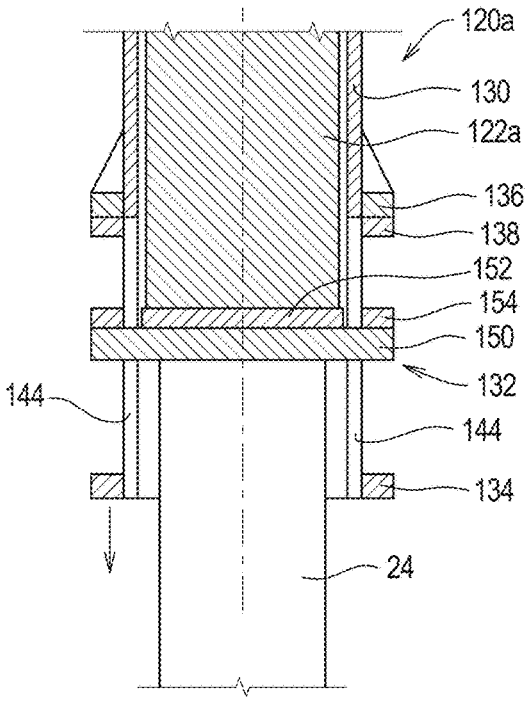
FIG. 7A is a side section view of the first example drop hammer pile driving system as depicted in FIG. 7.

With the hammer member 122*a* supported on a top surface 24*a* of the pile 24 by the drop plate assembly 132 as shown in FIGS. 6 and 6A, operation of the support system 22 to lower the housing member 130 allows the housing member 130 to move down until an upper end 126 of the hammer member 122*a* reaches the engaging location X1. With the second drive wheel 190 in the first position, the drive first and second wheels 180 and 190 frictionally engage the hammer member 122*a* as shown in FIG. 7. FIGS. 7 and 7A illustrate the hammer member 122*a* and drop plate assembly 132 in an intermediate position in which the drop plate assembly 132 moves within the plate slots 144 relative to the housing member 130.

Next, with the second drive wheel 190 in the first position, operating the drive wheel axle/motor assembly 182 rotates the first drive wheel 180. Rotation of the first drive wheel 180 causes linear displacement the hammer member 122*a* up along the drive axis AD relative to the housing member 130 as shown by a comparison of FIGS. 7 and 8. The drop plate assembly 132, which is resting on top of the pile 24, stays in position while the housing member 130 moves down until the housing bumper(s) 154 of the drop plate assembly 132 engage the stop bumpers 138 supported by the housing member 130 as shown in FIG. 8A. At this point, the drop plate assembly 132 prevents further downward movement of the housing member 130.

Figure 8:
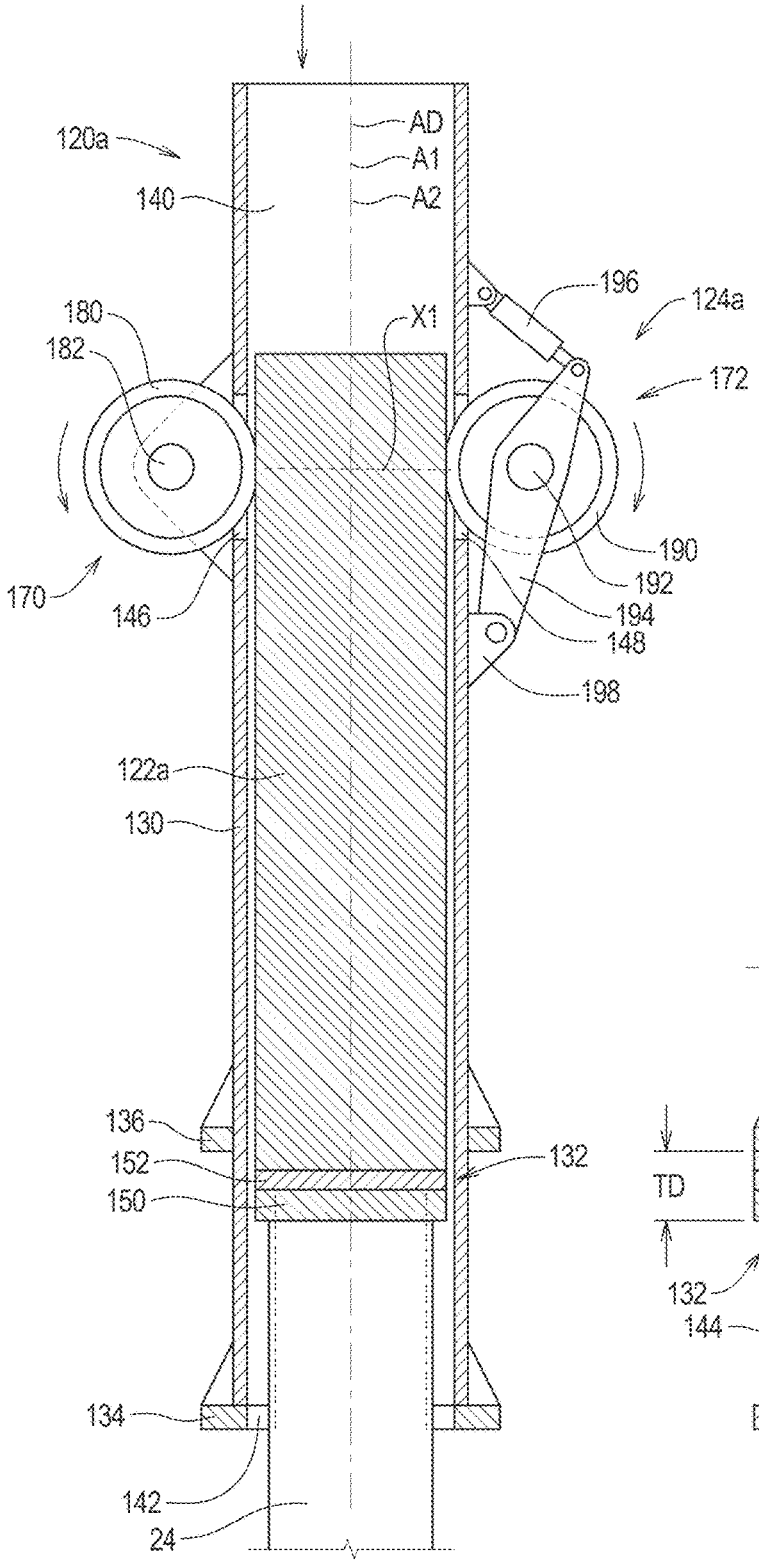
FIG. 8 is a front section view of the first example drop hammer pile driving system similar to FIG. 6, where the hammer member is in an intermediate drive system engagement position relative to the housing assembly and the drive system is in the first configuration.
Figure 8A:
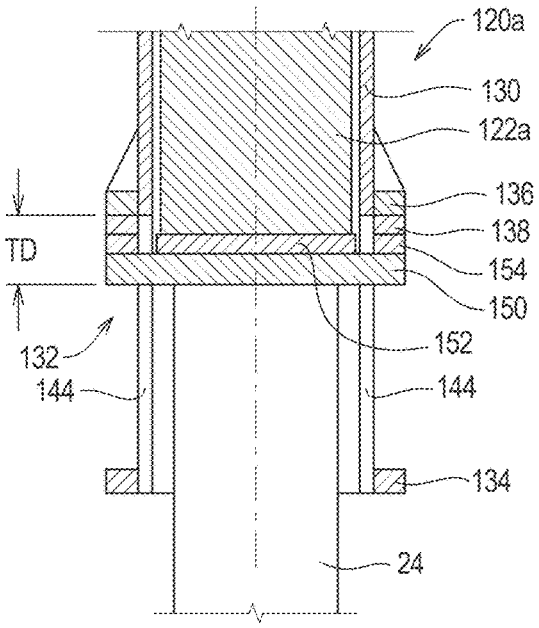
FIG. 8A is a side section view of the first example drop hammer pile driving system as depicted in FIG. 8.
Figure 9:
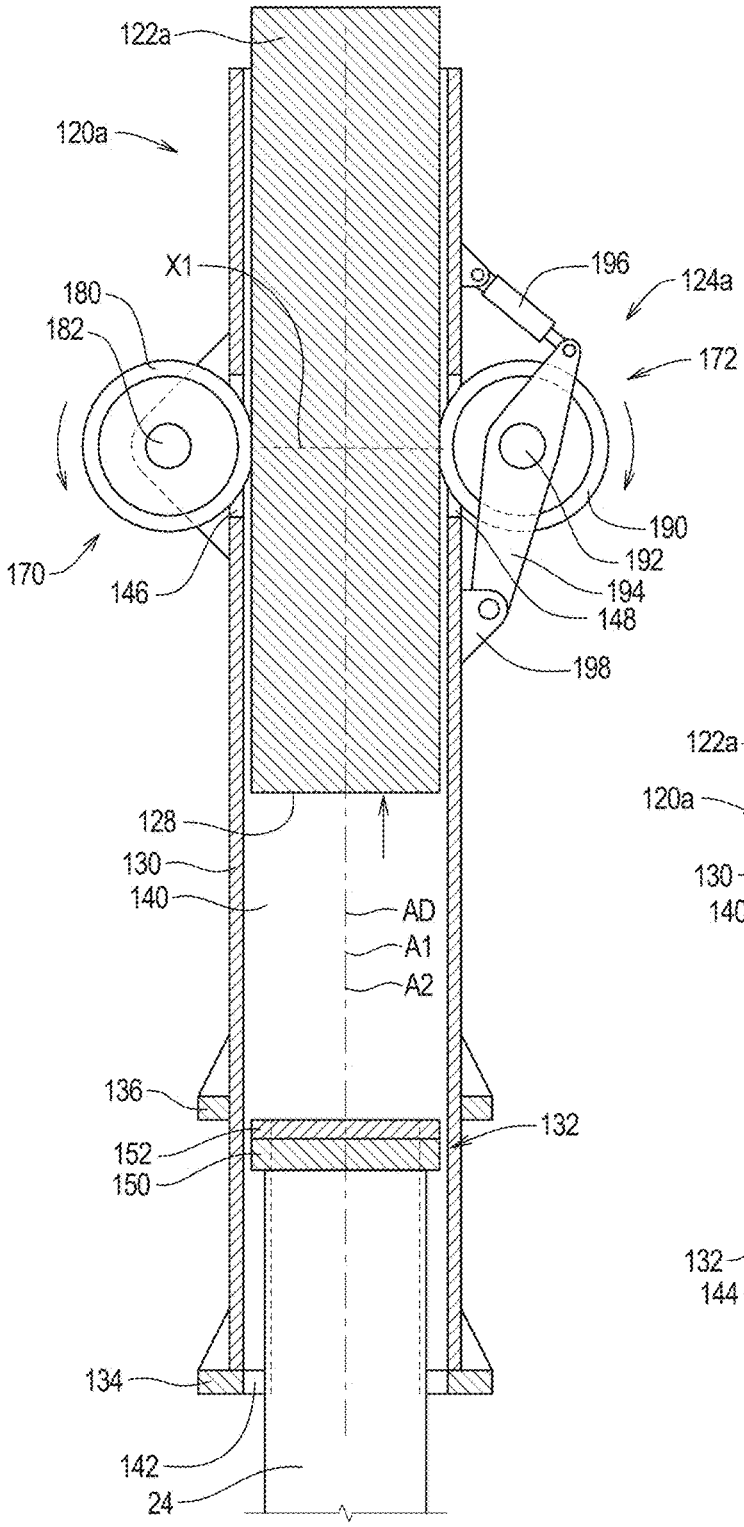
FIG. 9 is a front section view of the first example drop hammer pile driving system similar to FIG. 6, where the hammer member is in a desired drop position relative to the housing assembly and the drive system is in the first configuration.
Figure 9A:
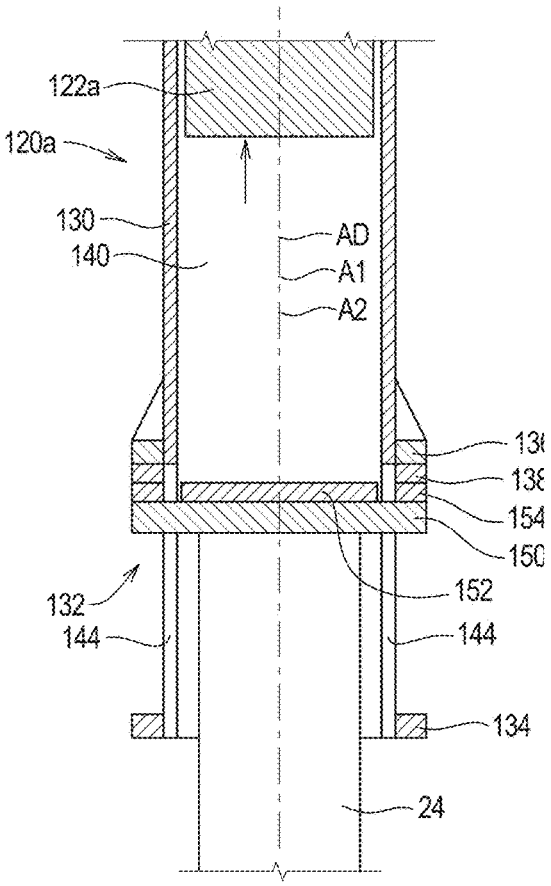
FIG. 9A is a side section view of the first example drop hammer pile driving system as depicted in FIG. 9.

With the housing member 130 supported by the drop plate assembly 132, which in turn supported by the pile 24 as shown in FIG. 9A, continued operation of the motor assembly 186 further displaces the hammer member 122*a* up relative to the housing assembly 120*a* as shown by a comparison of FIGS. 8 and 9.

Figure 10:
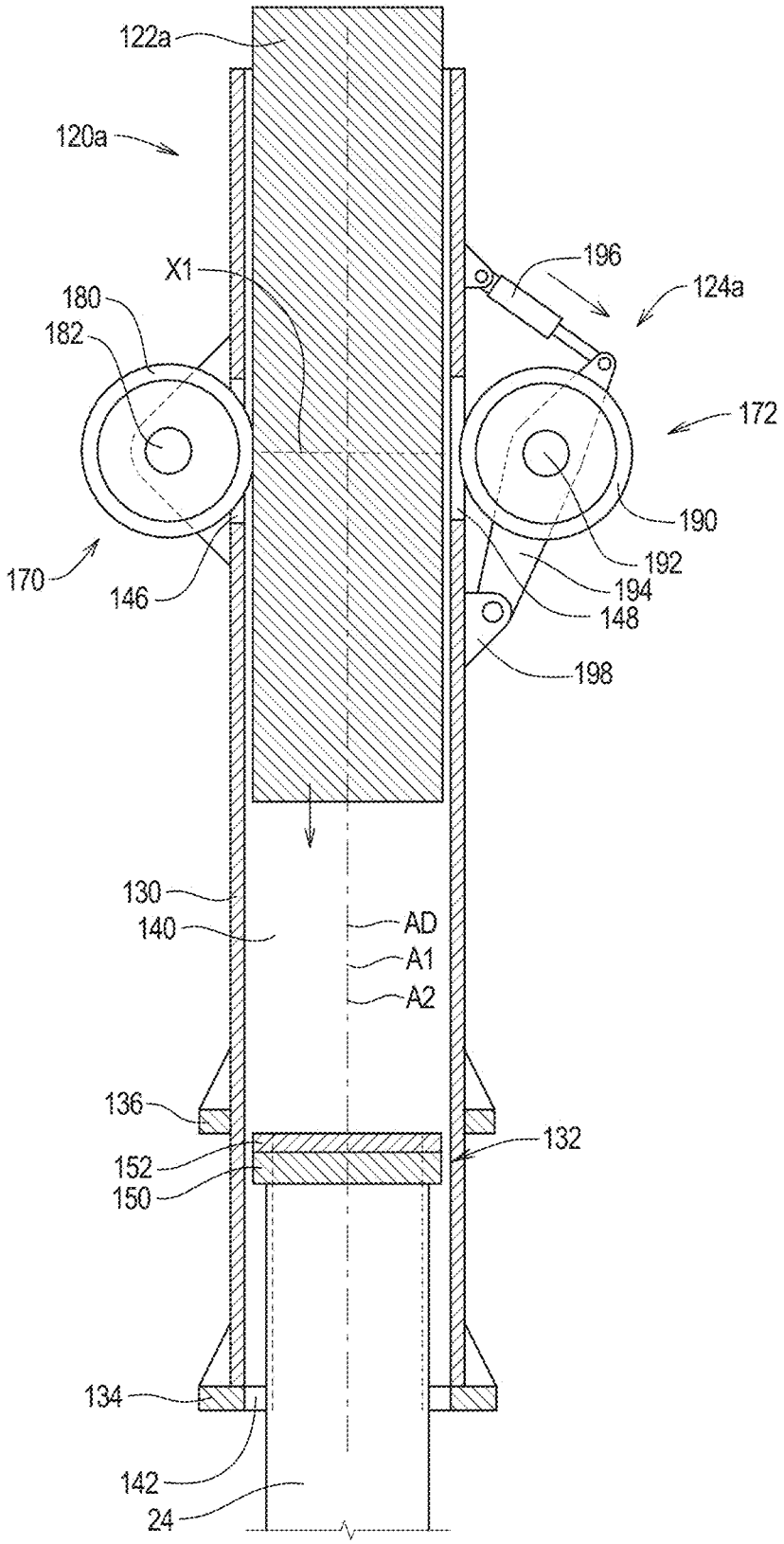
FIG. 10 is a front section view of the first example drop hammer pile driving system similar to FIG. 6, where the hammer member is in the desired drop position relative to the housing assembly and the drive system is in the second configuration.
Figure 11:
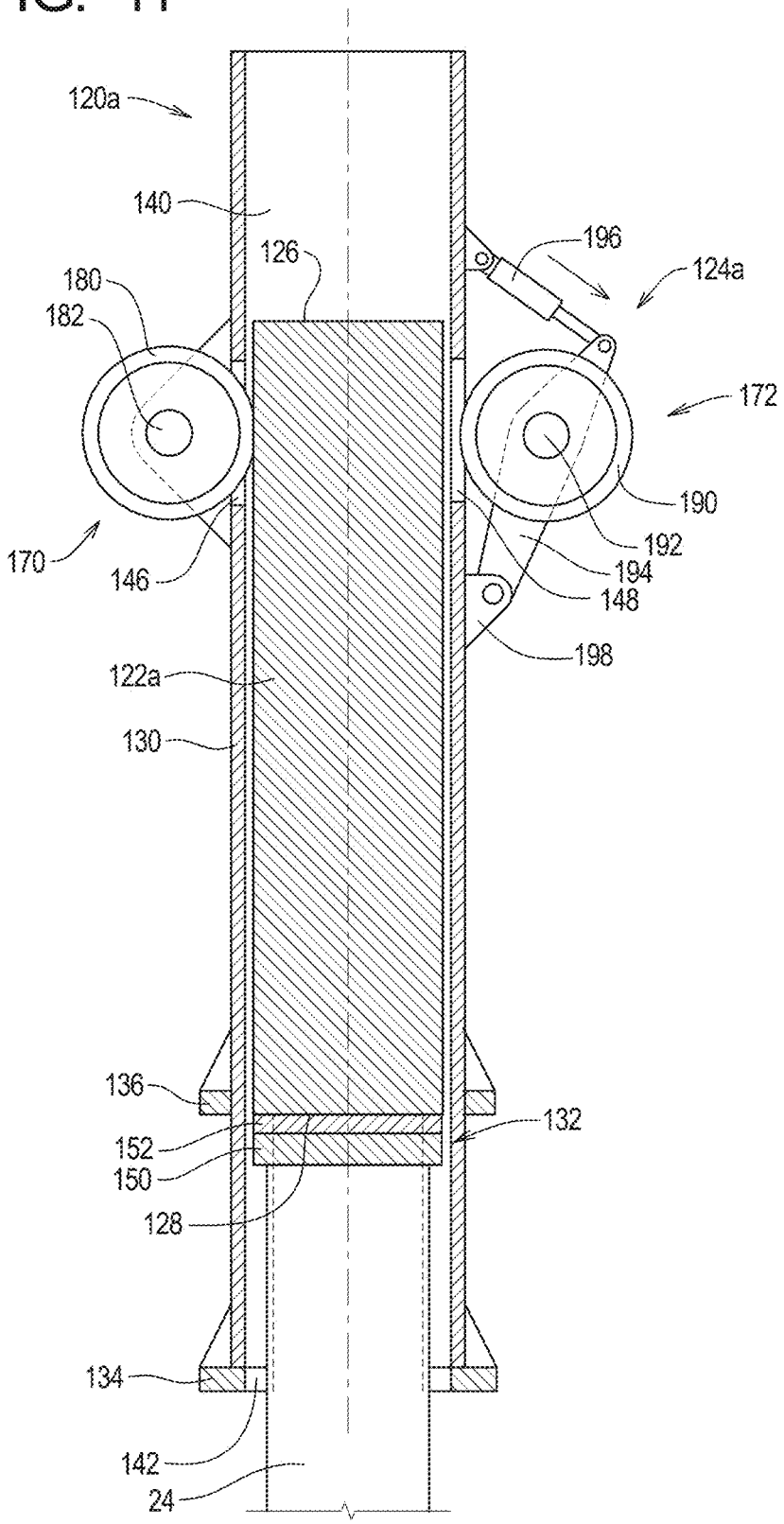
FIG. 11 is a front section view of the first example drop hammer pile driving system similar to FIG. 6, where the hammer member is in an impact position relative to the housing assembly and the drive system is in the second configuration.

When the hammer member 122*a* reaches a desired drop position above the drop plate assembly 132, the second drive wheel pivot arm actuator assembly 196 is extended to place the second drive wheel 190 into the second position as shown in FIG. 10. At this point, the reaction force on the hammer member 122*a* supplied by the second drive wheel 190 is removed, and the first drive wheel 180 no longer frictionally engages the hammer member 122. At this point, rotation of the first drive wheel 180 no longer holds the hammer member in the desired drop position, and the hammer member 122*a* moves down relative to the housing assembly 120*a* and impacts the top surface 24*a* of the pile 24 through the drop plates assembly 132 such that a driving force is applied to the pile 24 as shown in FIG. 11.

Figure 12:
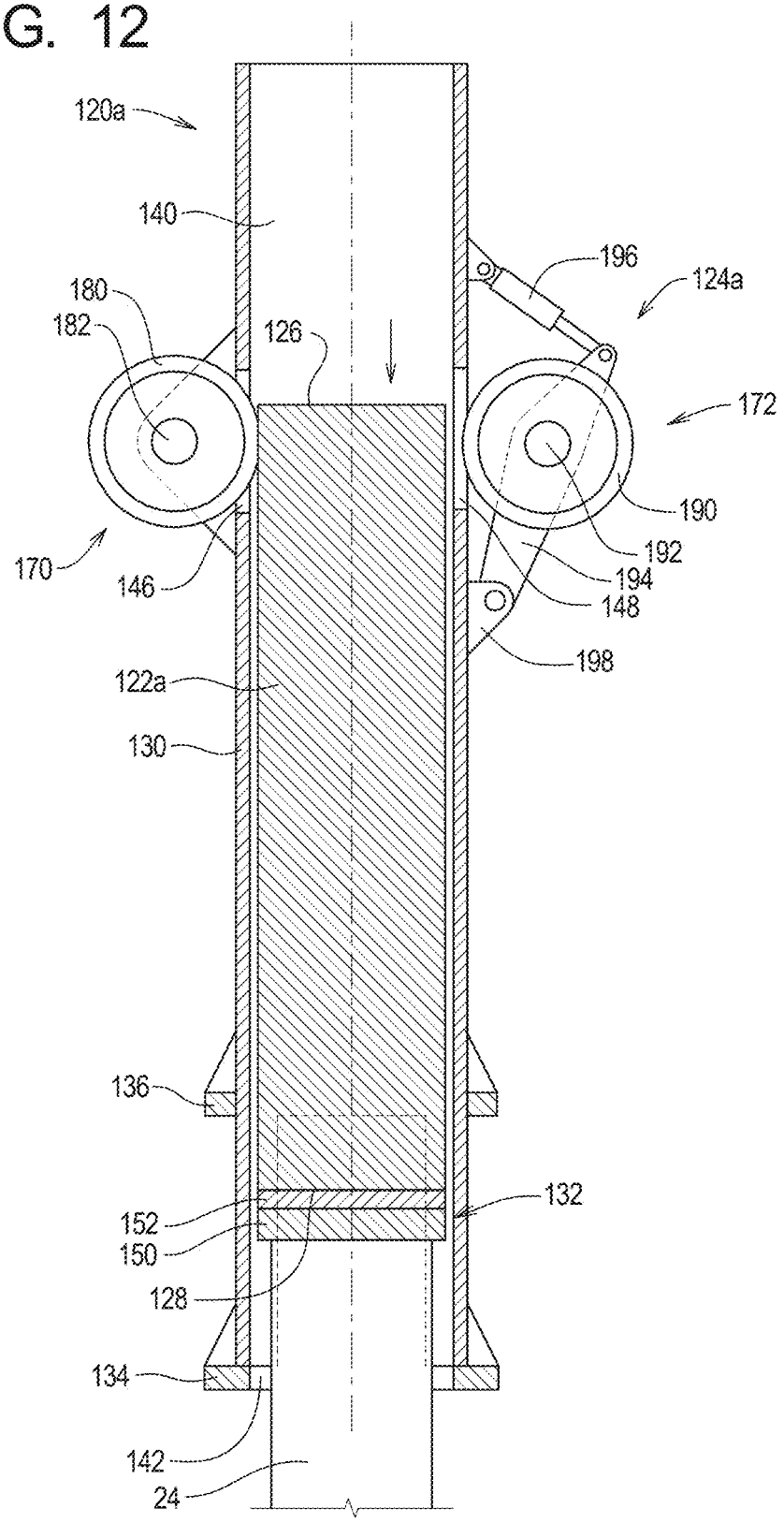
FIG. 12 is a front section view of the first example drop hammer pile driving system similar to FIG. 6, where the hammer member is in the third hammer position relative to the housing assembly and the drive system is in the second configuration.
Figure 13:
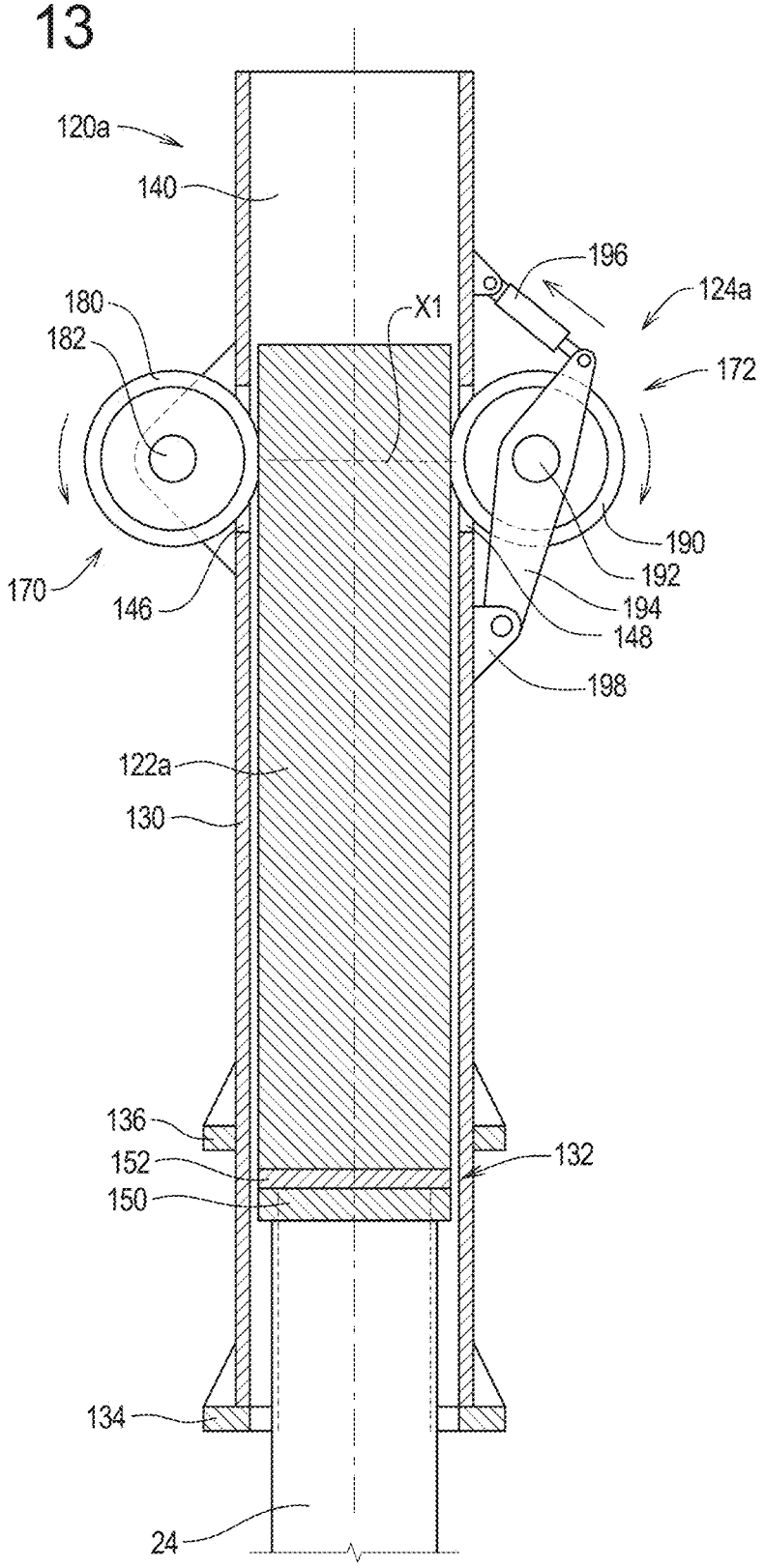
FIG. 13 is a front section view of the first example drop hammer pile driving system similar to FIG. 6, where the hammer member is returned to the intermediate drive system engagement position relative to the housing assembly and the drive system is in the first configuration.

As shown in FIG. 12, continued downward movement of the hammer member 122*a* after impact drives pile 24 into the earth 26 a distance determined by factors such as the weight of the housing assembly 120*a*, the weight of the hammer member 122*a*, the configuration and weight of the pile 24, and soil conditions at the desired location 28 in the earth.

When the pile 24 stops moving, the housing assembly 120*a* drops relative to the pile 24, the hammer member 122*a*, and the drop plate assembly 132 until the drop plate assembly 132 engages the housing member 130. At this point, the second drive wheel pivot arm actuator assembly 196 is operated to rotate the second drive wheel pivot arm 194 such that the second drive wheel 190 will come into contact with the hammer member 122 when the housing member 130 is dropped (similar to FIG. 6). With the first and second drive wheels 180 and 190 in contact with the hammer member 122*a* and the first drive wheel 180 rotated by the drive wheel axle/motor assembly 182, the drive system 124 raises the hammer member 122*a* relative to the housing assembly 120*a* and the pile 24 to begin the lift and drop cycle again.

The lift and drop cycle as described above is repeated until the pile 24 is driven into the earth 26 to a desired depth at the desired location 28.

The configurations of the housing assembly 120*a*, hammer member 122*a*, and drive system 124*a* and the materials used to fabricate these components are not critical so long as these components function to drive the pile 24 into the earth 26 as described herein.

In that context, the example hammer member 122*a* is a solid steel structure and the example housing member 130 is a hollow steel structure, and both the example hammer member 122*a* and the example housing member 130 that are generally square or rectangular in cross-sectional shape. However, other materials and combinations of materials may be used to form the hammer member 122*a* and the housing member 130 as appropriate to accommodate the loads generated by the operation of the first example drop hammer pile driving system 20*a*.

Figure 3A:
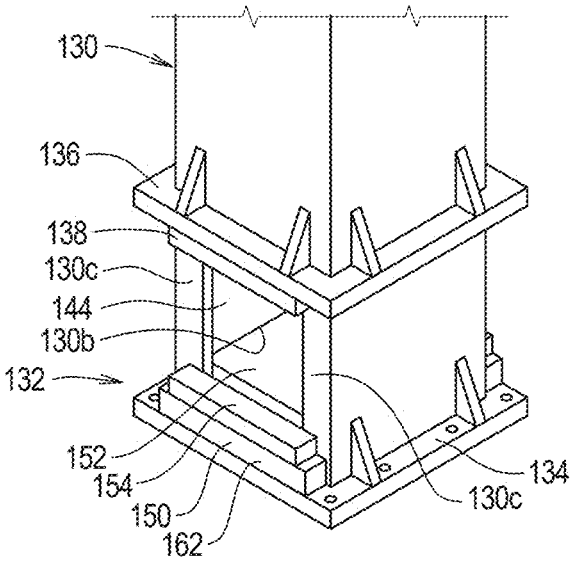
FIG. 3A is a top perspective view of a bottom end of a housing assembly of the first example drop hammer pile driving system.
Figure 3B:
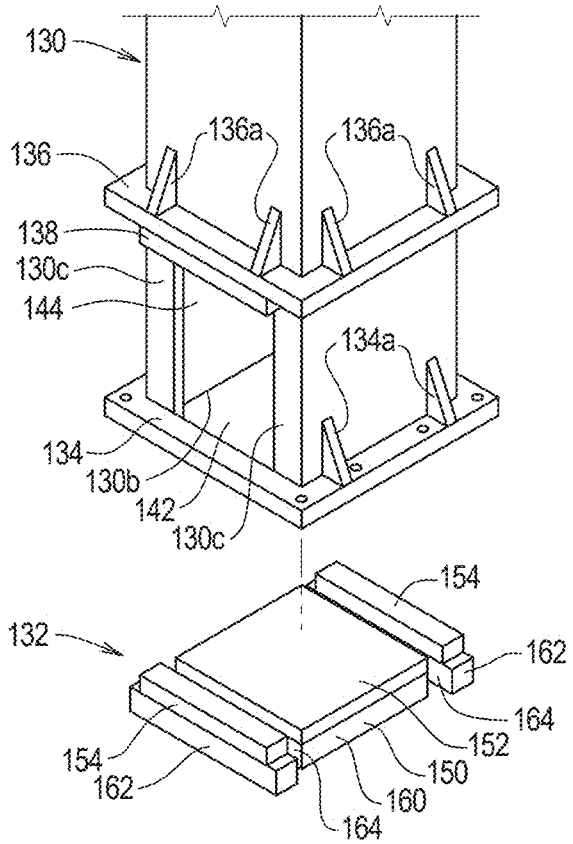
FIG. 3B is a top perspective partially exploded view of the bottom end of the housing assembly of the first example drop hammer pile driving system.
Figure 3C:
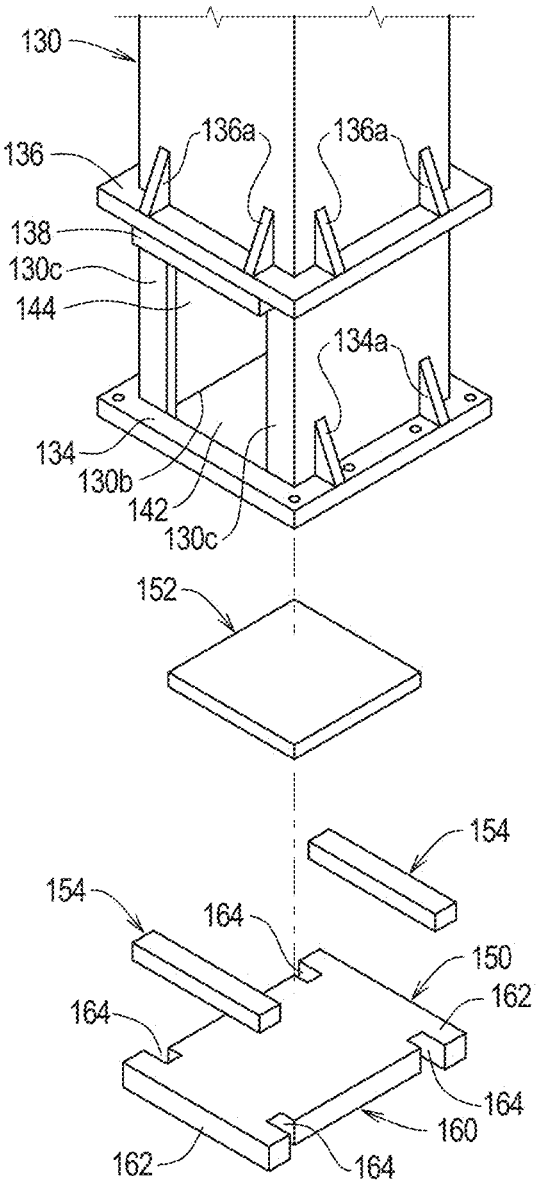
FIG. 3C is a top perspective exploded view of the bottom end of the housing assembly of the first example drop hammer pile driving system.

In the example housing assembly 120, the first and second brace plates 134 and 136 are welded to the housing member 130. More specifically, FIGS. 3A, 3B, and 3C illustrate that the example first brace plate 134 is welded to a lower edge 130*b* of the housing member 130 and that the example second brace plate 136 is welded to an intermediate location on the housing member 130. The intermediate location at which the second brace plate 136 is supported on the housing member 130 is determined by an uppermost edge of the example plate slot(s) 144 formed in the housing member 130. Gussets 134*a* and 136*a* may be welded between the housing member 130 and the brace plates 134 and 136 to reinforce the connections between the housing member 130 and the brace plates 134 and 136, respectively. The example stop bumpers 138 are resilient members secured to a lower surface of the example second brace plate 136 facing the plate slot(s) 144.

The example drop plate 150 is formed by a steel plate cut, machined, stamped, forged, or otherwise shaped to define the guide portions 162 extending from the impact portion 160 and the guide spaces 164 arranged between at least a portion of the impact portion 160 and the guide portions 162. The example drop plate 150 is further sized and dimensioned such that the impact portion 160 of the drop plate 160 may be arranged within the housing chamber 140. With the impact portion 160 of the drop plate 150 arranged within the housing chamber 140, the guide portions 162 are arranged outside of the housing chamber 140 as best shown in FIG. 3A. With the impact portion 160 of the drop plate 160 arranged within the housing chamber 140 and the guide portions 162 arranged outside of the housing chamber 140, the guide spaces 164 receive wall portions 130*c* of the housing member 130 such that, during normal use of the first example drop hammer pile driving system 20*a*, movement of the example drop plate assembly 132 is limited to linear displacement relative to the example housing member 130 along a drop plate path aligned with the drive axis AD.

The example hammer bumper 152 is secured to the impact portion 160 of the drop plate 150, and the example housing bumper(s) 154 are secured to the guide portion(s) 162 of the drop plate 150. The example hammer bumper 152 is thus located within the housing chamber 140 and the example housing bumpers 154 are located outside the housing chamber 140 when the housing assembly 120*a* is formed. Further, the guide portions 162 engage the first brace plate 134 to define a drop plate path lower limit (e.g., FIGS. 5 and 6A) and the housing bumpers 154 engage the stop bumpers 138 to define a drop plate path upper limit (e.g., FIGS. 8A and 9A). FIG. 7A illustrates the example drop plate assembly 132 at an intermediate location along the drop plate path between the drop plate path lower limit and the drop plate path upper limit.

II. Second Example Drop Hammer Pile Driving System

Figure 14:
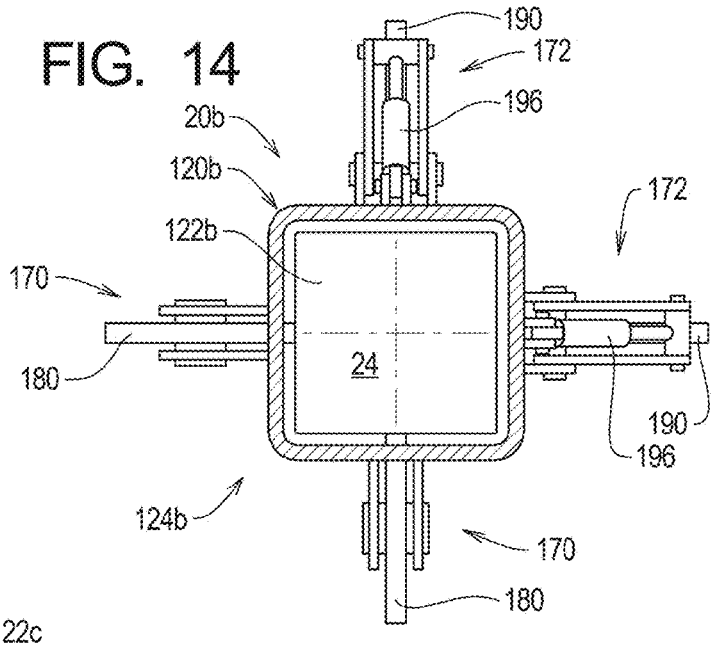
FIG. 14 is a section view similar to FIG. 4 of a second example drop hammer pile driving system of the present invention.

Referring now to FIG. 14 of the drawing, depicted therein is a second example drop hammer pile driving system 20*b* constructed in accordance with, and embodying, the principles of the present invention. The second example drop hammer pile driving system 20*b* may constructed in substantially the same as the first example drop hammer pile driving system 20*a*, and the second example drop hammer pile driving system 20*b* will be described herein primarily to the extent that it differs from the first example drop hammer pile driving system 20*a*.

The second example drop hammer pile driving system 20*b* comprises a housing assembly 120*b*, a hammer member 122*b*, and a drive system 124*b*. The example second housing assembly 120*b* is similar to the first example housing assembly 120*a* but defines two of the first drive slots 146 and two of the second drive slots 148 (not shown). In the second example drop hammer pile driving system 20*b*, the first drive slots 146 (not shown) are arranged on adjacent walls of the housing member 130*a* and each of the second drive slots 148 (not shown) is formed in a wall of the housing member 130*a* opposite one of the first drive slots 146.

The second example drive system 124*b* comprises two of the first drive wheel assemblies 170 and two of the second drive wheel assemblies 172. Each of the first drive wheel assemblies 170 is supported adjacent to one of the first drive slots 146 (not shown). Each of the second drive wheel assemblies 172 is supported adjacent to one of the second drive slots 148 (not shown).

The second example drive system 124*b* is or may be operated in the same basic manner as the first example drive system 124*a* described above.

III. Third Example Drop Hammer Pile Driving System

Figure 15:
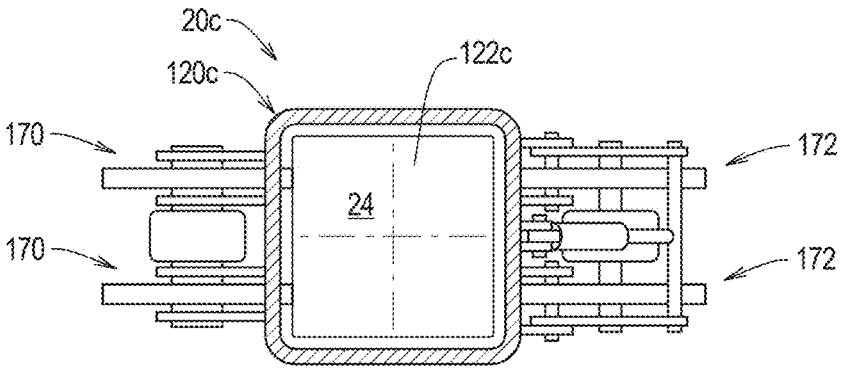
FIG. 15 is a section view similar to FIG. 4 of a third example drop hammer pile driving system of the present invention.
Figure 16:
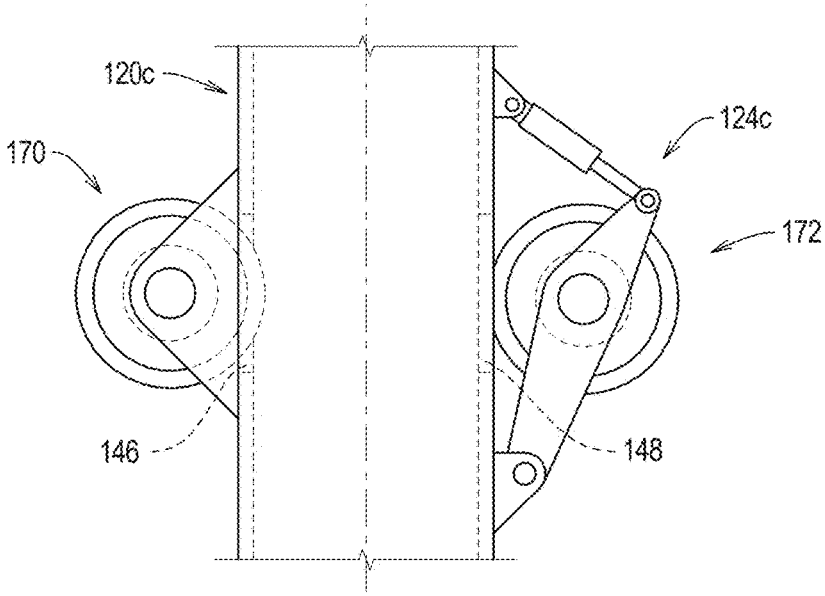
FIG. 16 is a side elevation view of a portion of the third example drop hammer pile driving system of the present invention with a drive system thereof in a second configuration.
Figure 17:
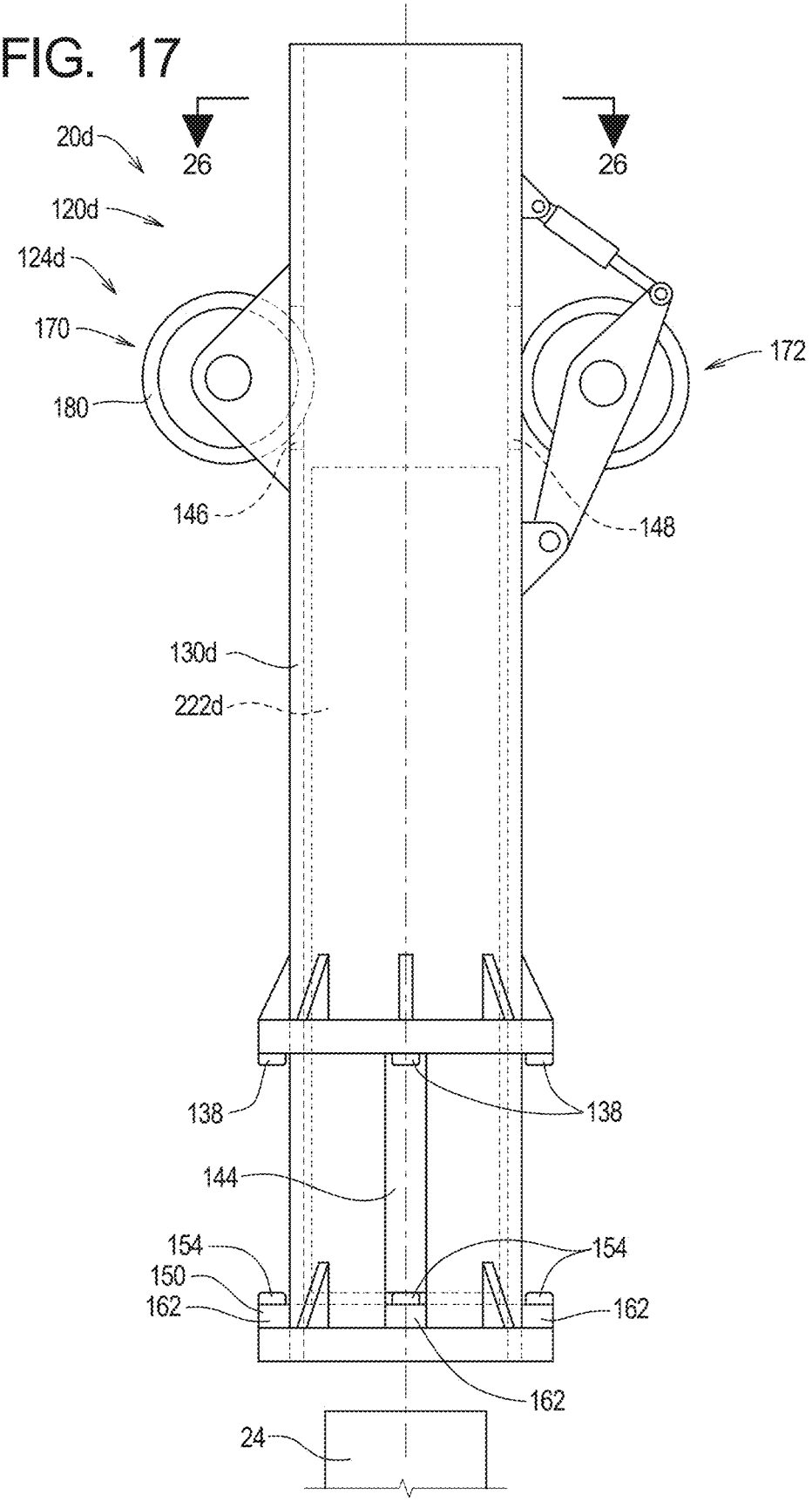
FIG. 17 is a side elevation view of a fourth example pile driving system of the present invention.
Figure 18:
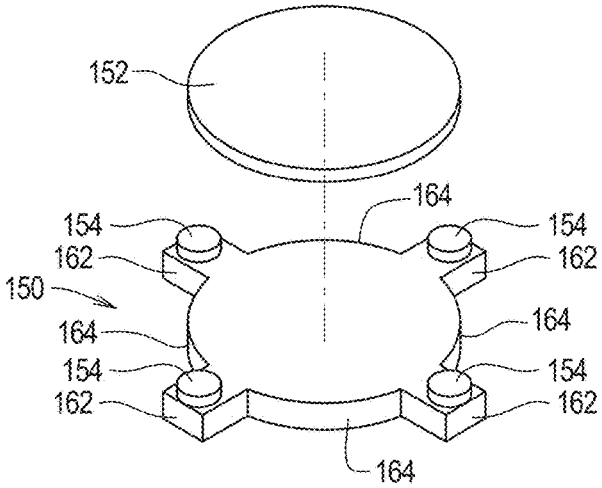
FIG. 18 is an exploded perspective view of an example drop plate assembly of the fourth example pile driving system
Figure 19:
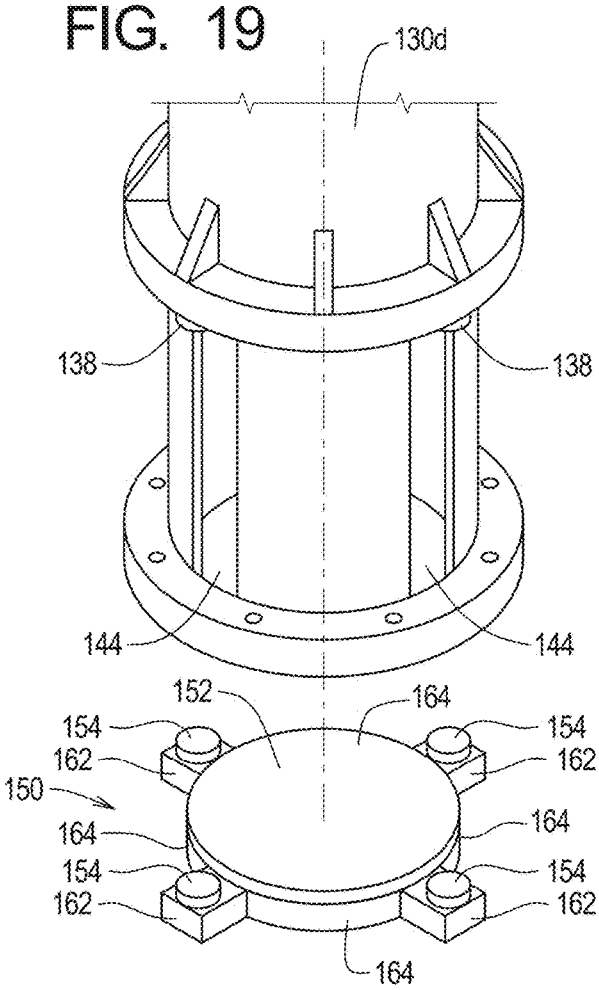
FIG. 19 is a top perspective exploded view of a bottom end of a housing assembly of the fourth example drop hammer pile driving system.
Figure 20:
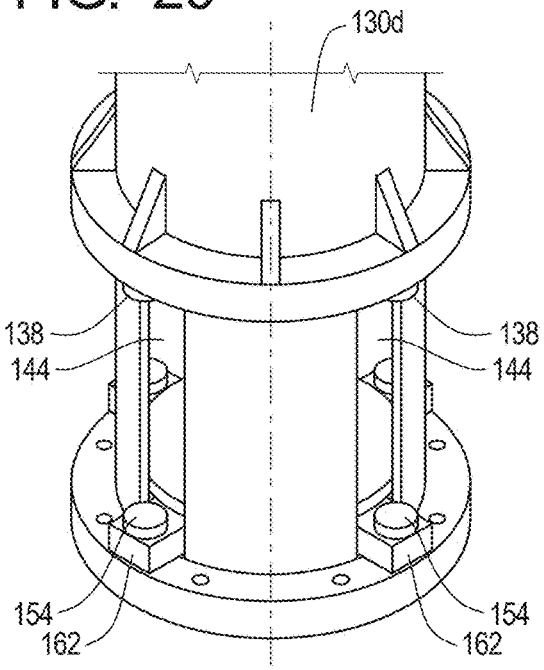
FIG. 20 is a top perspective assembled view of a bottom end of a housing assembly of the fourth example drop hammer pile driving system.
Figure 21:
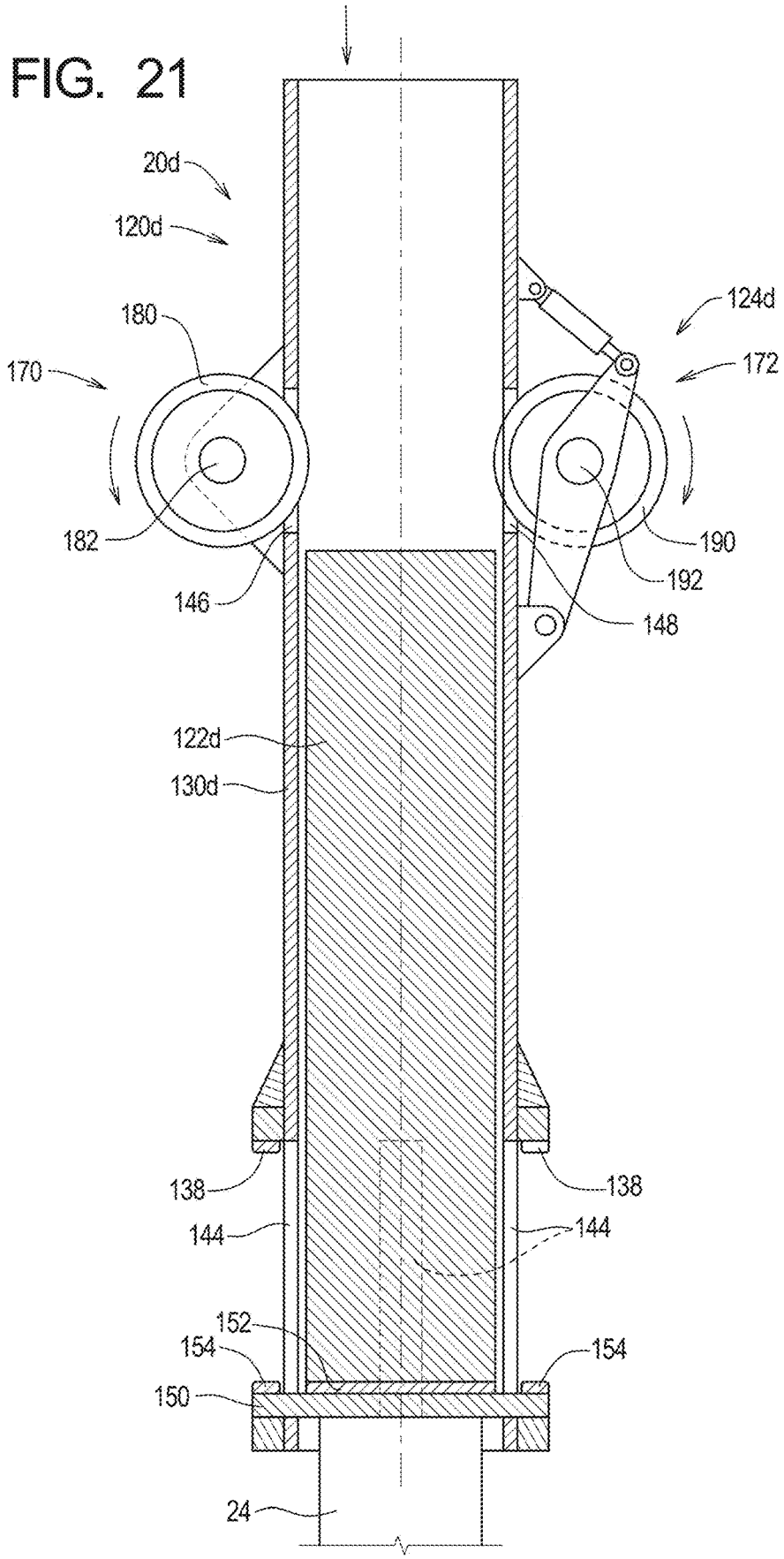
FIG. 21 is a front section view of the fourth example drop hammer pile driving system, where the hammer member is in the first hammer position relative to the housing assembly and the drive system is in a second configuration.
Figure 22:
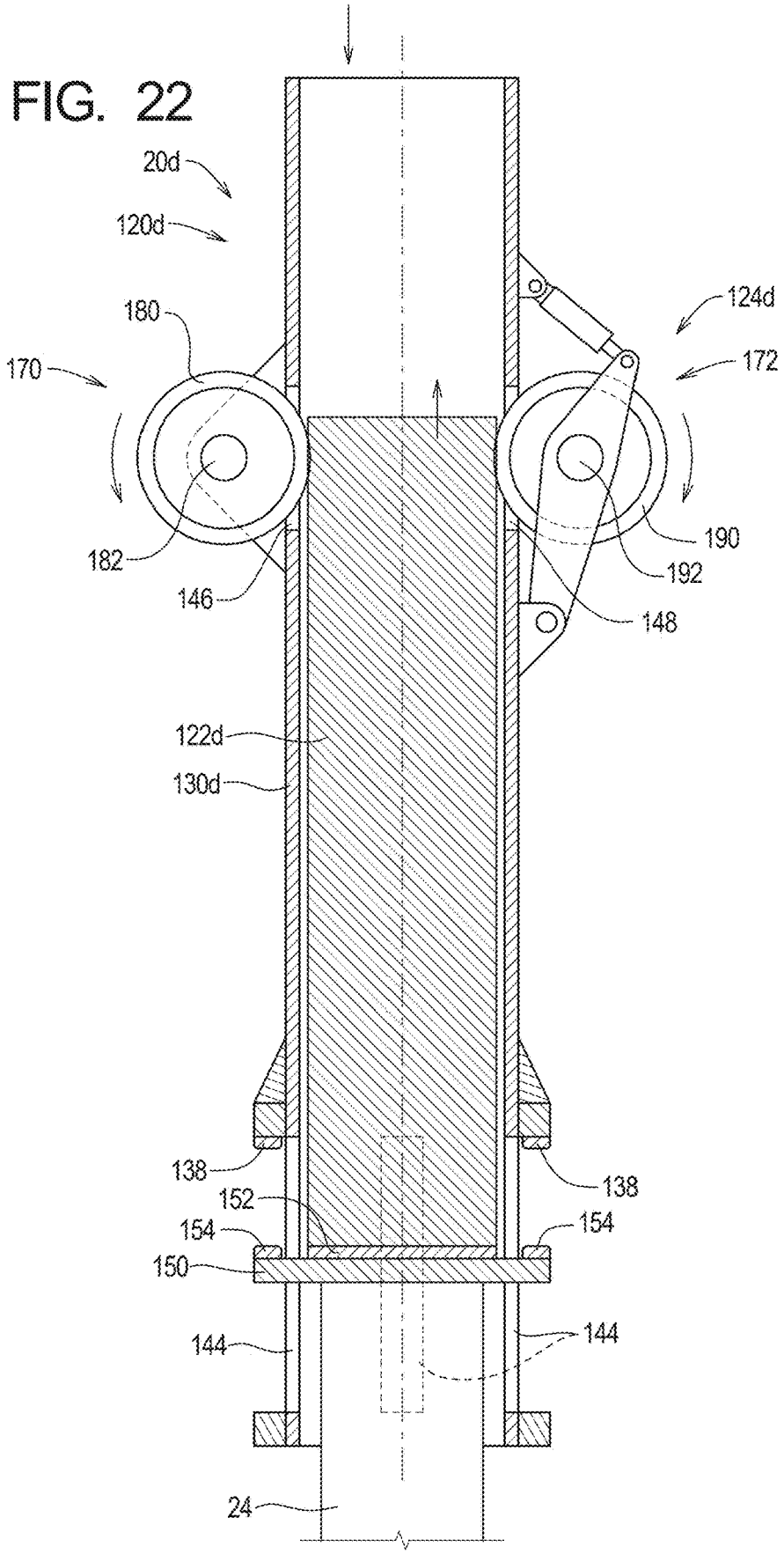
FIG. 22 is a front section view of the fourth example drop hammer pile driving system, where the hammer member is in a second hammer position relative to the housing assembly and the drive system is in the second configuration.
Figure 23:
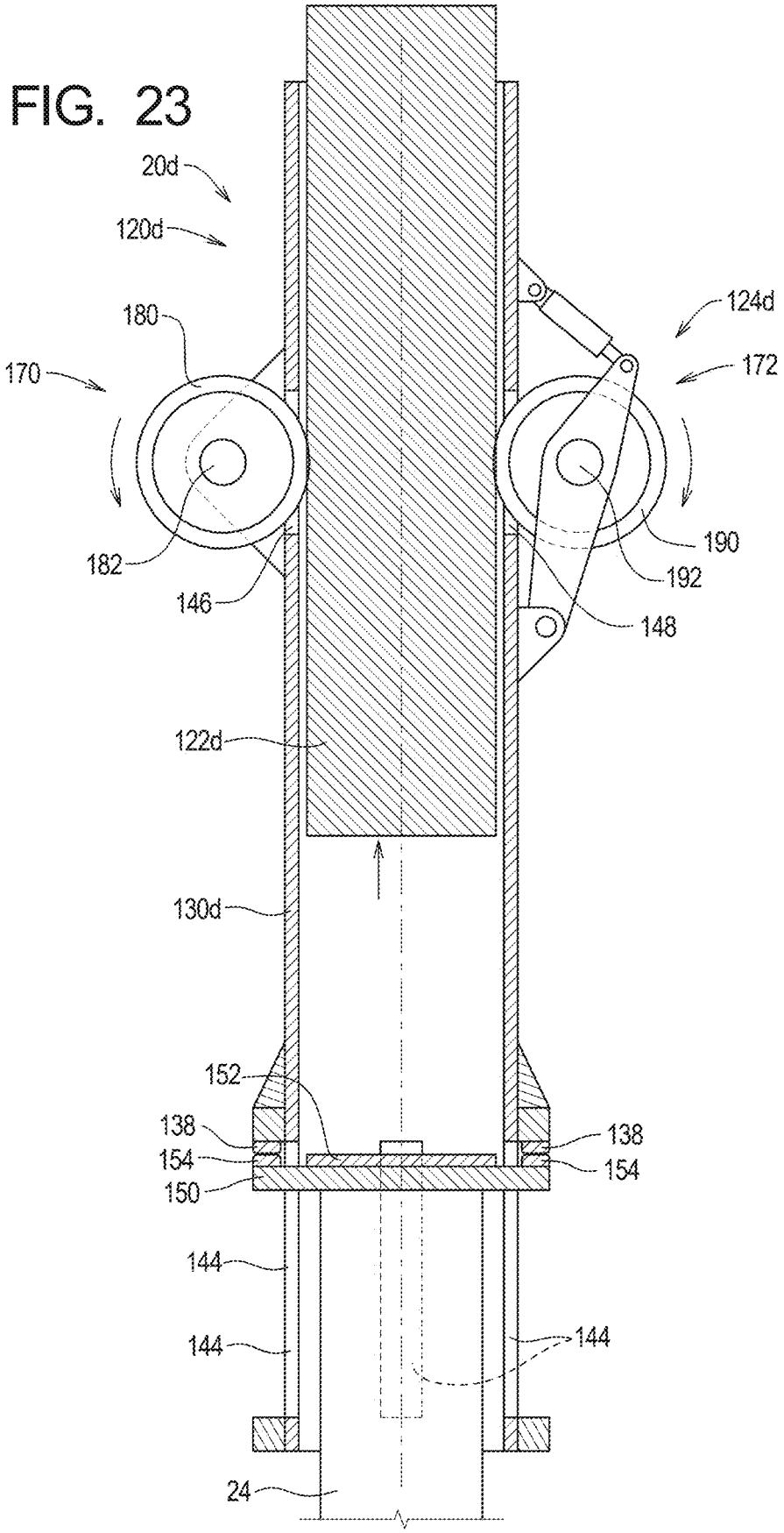
FIG. 23 is a front section view of the fourth example drop hammer pile driving system, where the hammer member is in a third hammer position relative to the housing assembly and the drive system is in the second configuration.
Figure 24:
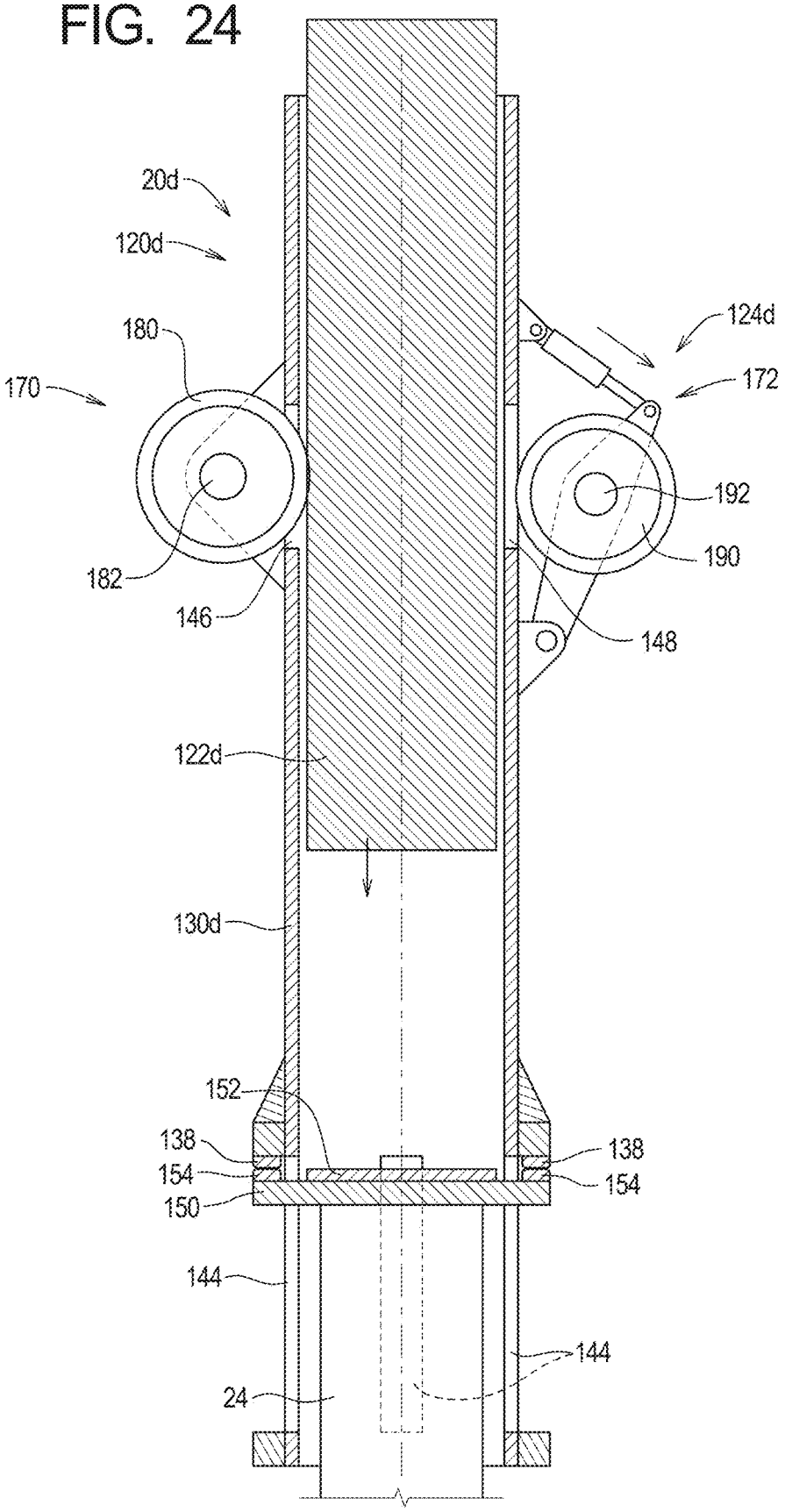
FIG. 24 is a front section view of the fourth example drop hammer pile driving system, where the hammer member is in the third hammer position relative to the housing assembly and the drive system is in the first configuration.
Figure 25:
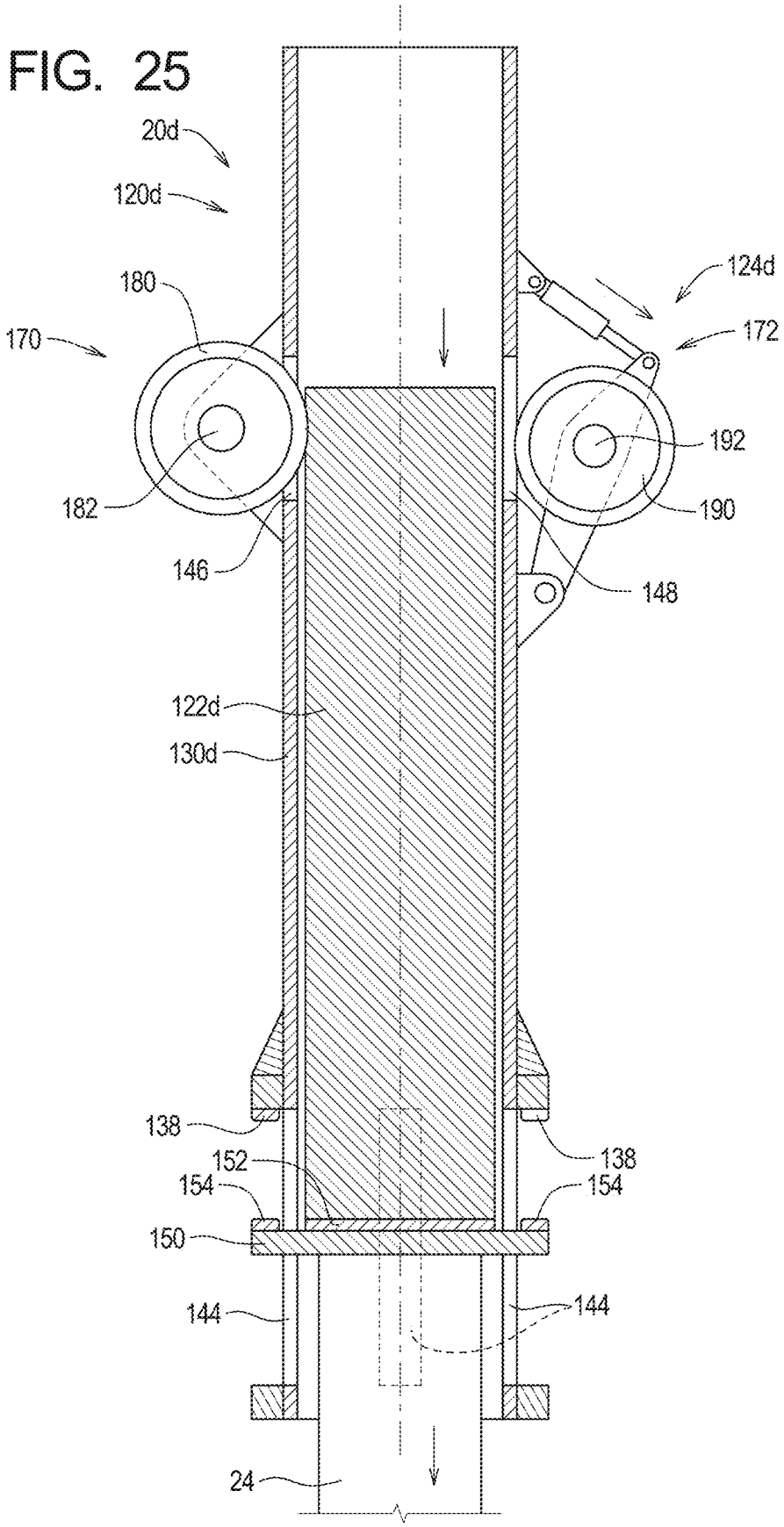
FIG. 25 is a front section view of the fourth example drop hammer pile driving system similar to FIG. 6, where the hammer member is in the second hammer position relative to the housing assembly and the drive system is in the first configuration.
Figure 26:
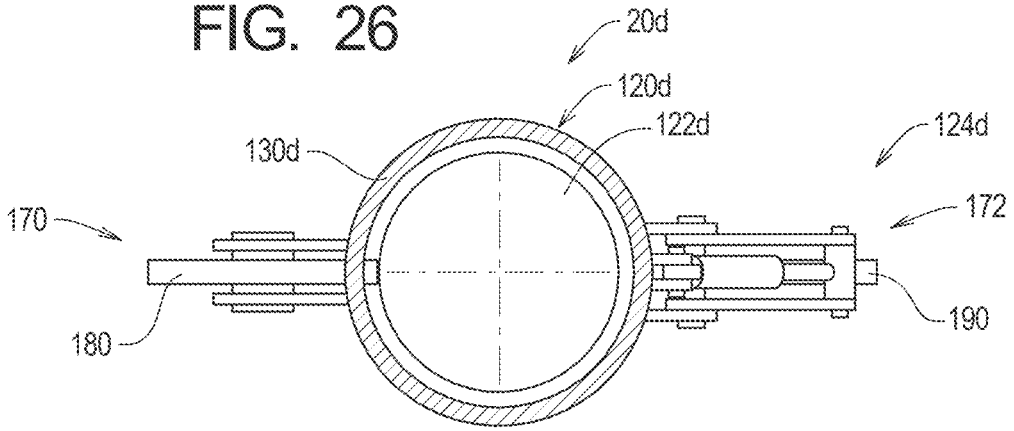
FIG. 26 is a section view of the fourth example drop hammer pile driving system of the present invention.

Referring now to FIGS. 15 and 16 of the drawing, depicted therein is a third example drop hammer pile driving system 20*c* constructed in accordance with, and embodying, the principles of the present invention. The third example drop hammer pile driving system 20*c* may constructed in substantially the same as the first and second example drop hammer pile driving systems 20*a* and 20*b*, and the third example drop hammer pile driving system 20*c* will be described herein primarily to the extent that it differs from the first and second example drop hammer pile driving systems 20*a* and 20*b*.

The third example drop hammer pile driving system 20*c* comprises a housing assembly 120*c*, a hammer member 122*c*, and a drive system 124*c*. The example third housing assembly 120*c* is similar to the first and second example housing assemblies 120*a* and 120*b* and, like the second example housing assembly 120*b*, defines two of the first drive slots 146 and two of the second drive slots 148. However, in the third example drop hammer pile driving system 20*c*, the first drive slots 146 are arranged next to each on a first wall of the housing member 130*c* and each of the second drive slots 148 are formed next to each other on a second wall of the housing member 130*c*, where the second wall is opposite the first wall in which the first drive slots 146 are formed.

The third example drive system 124*c* comprises two of the first drive wheel assemblies 170 and two of the second drive wheel assemblies 172. Each of the first drive wheel assemblies 170 is supported by the first wall adjacent to one of the first drive slots 146. Each of the second drive wheel assemblies 172 is supported on the second wall adjacent to one of the second drive slots 146.

The third example drive system 124*c* is or may be operated in the same basic manner as the first example drive system 124*a* described above.

IV. Fourth Example Drop Hammer Pile Driving System

Referring now to FIGS. 17-26 of the drawing, depicted therein is a fourth example drop hammer pile driving system 20*d* constructed in accordance with, and embodying, the principles of the present invention. The fourth example drop hammer pile driving system 20*d* may constructed in substantially the same as the first, second, and third example drop hammer pile driving systems 20*a*, 20*b*, and 20*c*, and the fourth example drop hammer pile driving system 20*d* will be described herein primarily to the extent that it differs from the example drop hammer pile driving systems 20*a*, 20*b*, and 20*c*.

The fourth example drop hammer pile driving system 20*d* comprises a housing assembly 120*d*, a hammer member 122*d*, and a drive system 124*d*. The example fourth housing assembly 120*d* is similar to the first, second, and third example housing assemblies 120*a*, 120*b*, and 120*c* except that the housing member 130*d* of the fourth example drop hammer pile driving system 20*d* is generally circular in cross-sectional shape. Accordingly, the first drive slots 146 of the fourth example drop hamper driving system 20*d* are arranged opposite of the second drive slots 148 on the circular wall of the housing member 130*d*. The first drive wheel assembly 170 is thus located opposite the second drive wheel assembly 172 to apply an opposing force against the pile 24 to facilitate frictional engagement of the first drive wheel 180 with the pile 24 during operation of the drive system 124*d*.

With the example circular housing member 130*d*, the plate slots 144 are formed at equally spaced locations about an axis of the housing member 130*d*. In the example housing member 130*d*, four of the plate slots 144 are formed. Accordingly, the example drop plate 150 defines four guide portions 162 and four associated guide spaces 164, with guide portions 162 received by the plate slots 144 and the guide spaces 164 receiving wall portions of the example housing member 130*d*.

The example housing member 130 supports four of the stop bumpers 138, one arranged to engage one each of the four guide portions 162. Further, the hammer bumper 152 of the fourth example drop plate assembly 132*a* is circular, and four of the housing bumpers 154 are provided, one for each of the four guide portions 162.

FIGS. 21-25 illustrate that the fourth example drop hammer pile driving system 20*d* operates through a lifting and dropping cycle similar to that of the first example drop hammer pile driving system 20*a* as described above.

V. Fifth Example Drop Hammer Pile Driving System

Figure 27:
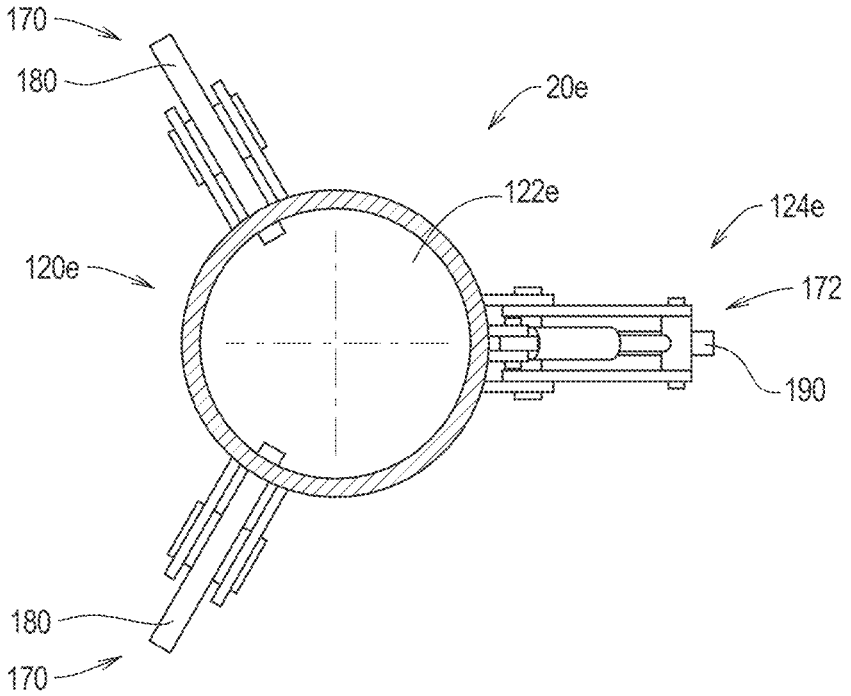
FIG. 27 is a section view of a fifth example drop hammer pile driving system of the present invention.

Referring now to FIG. 27 of the drawing, depicted therein is a fifth example drop hammer pile driving system 20*e* constructed in accordance with, and embodying, the principles of the present invention. The fifth example drop hammer pile driving system 20*e* may constructed in substantially the same as the first, second, third, and fourth example drop hammer pile driving systems 20*a*, 20*b*, 20*c*, and 20*d*, and the fifth example drop hammer pile driving system 20*e* will be described herein primarily to the extent that it differs from the example drop hammer pile driving systems 20*a*, 20*b*, 20*c*, and 20*d*.

The fifth example drop hammer pile driving system 20*e* comprises a housing assembly 120*e*, a hammer member 122*e*, and a drive system 124*e*. The example fifth housing assembly 120*e* is similar to the first, second, third, and fourth example housing assemblies 120*a*, 120*b*, 120*c*, and 120*d* except that, like the fourth example housing assembly 120*d*, the housing member 130*e* of the fifth example drop hammer pile driving system 20*e* is generally circular in cross-sectional shape.

Further, the fifth example drop hammer pile driving system 20*e* comprises two of the first drive slots 146 (not shown) and one of the second drive slots 148 (not shown) arranged at equally spaced locations on the circular wall of the housing member 130*e*. Two first drive wheel assemblies 170 are thus located opposite a single second drive wheel assembly 172 such that the single second drive wheel assembly 172 applies an opposing force against the pile 24 to facilitate frictional engagement of the first drive wheels 180 of the two first drive wheel assemblies 170 with the hammer member 122*e* during operation of the drive system 124*e*.

What is claimed is:

1. A drop hammer pile driving system for driving a pile defining a pile upper end, the drop hammer pile driving system comprising:

a housing assembly comprising a housing member defining a housing chamber, a pile opening, at least one plate slot, at least one first drive slot, and at least one second drive slot, where the at least one first drive slot and the at least one second drive slot define an engaging location relative to the housing assembly, and a drop plate assembly, where at least a portion of the drop plate assembly is arranged within the housing chamber, and at least a portion of the drop plate assembly is arranged within the at least one plate slot to limit movement of the drop plate assembly relative to the housing member;

a hammer member arranged within the housing chamber for movement relative to the housing member and the drop plate assembly; and a drive system comprising a first drive wheel assembly comprising at least one first drive wheel and a first drive motor, where the at least one first drive wheel is arranged to extend into the at least one first drive slot, and a second drive wheel assembly at least one second drive wheel and an actuator assembly, where the actuator assembly is arranged and configured to displace the at least one second drive wheel between a first position in which the at least one second drive wheel does not extend through the at least one second drive slot, and a second position in which in which at least a portion of the at least one second drive wheel extends through the at least one second drive slot into the housing chamber; wherein with the pile upper end within the housing chamber, the drop plate assembly is arranged between the pile upper end and the hammer member; and the engaging location is arranged relative to the drop plate assembly such that when the pile upper end a first distance within the housing chamber and the drive wheel is in the second position, the pile upper end is below the engaging location, and when the pile upper end a second distance within the housing chamber, the pile upper end is at the engaging location; and when the pile upper end is at the engaging location and the drive wheel is in the second position, operation of the first drive motor rotates the first drive wheel such that the first and second drive wheels engage the hammer member such that the hammer member is lifted relative to the housing member.

2. The drop hammer assembly as recited in claim 1, in which the second drive wheel assembly further comprises a second drive motor, where operation of the second drive motor rotates the second drive wheel such that the first and second drive wheels engage the hammer member to lift the hammer member relative to the housing member.

3. The drop hammer assembly as recited in claim 1, in which the first drive wheel assembly further comprises a first axle member for supporting the first drive wheel for rotation relative to the housing assembly.

4. The drop hammer assembly as recited in claim 2, in which the second drive wheel assembly further comprises a second axle member for supporting the second drive wheel for rotation relative to the housing assembly.

5. The drop hammer assembly as recited in claim 1, in which the drop plate assembly comprises a drop plate defining:

an impact portion at least partly arranged within the housing chamber; and at least one guide portion at least partly arranged within one of the at least one plate slots formed in the housing chamber.

6. The drop hammer assembly as recited in claim 1, in which the drop plate assembly comprises:

a drop plate; and at least one hammer bumper configured to engage the hammer.

7. The drop hammer assembly as recited in claim 1, in which the drop plate assembly comprises:

a drop plate; and at least one housing bumper configured to engage the housing.

8. The drop hammer assembly as recited in claim 1, in which the drop plate assembly comprises:

a drop plate;

at least one hammer bumper configured to engage the hammer; and at least one housing bumper configured to engage the housing.

9. A method of driving a pile defining a pile upper end, the method comprising the steps of:

providing a housing assembly comprising a housing member defining a housing chamber, a pile opening, at least one plate slot, at least one first drive slot, and at least one second drive slot, where the at least one first drive slot and the at least one second drive slot define an engaging location relative to the housing assembly, and a drop plate assembly, where at least a portion of the drop plate assembly is arranged within the housing chamber, and at least a portion of the drop plate assembly is arranged within the at least one plate slot to limit movement of the drop plate assembly relative to the housing member;

arranging a hammer member within the housing chamber for movement relative to the housing member and the drop plate assembly; and providing a drive system comprising a first drive wheel assembly comprising at least one first drive wheel and a first drive motor, where the at least one first drive wheel is arranged to extend into the at least one first drive slot, and a second drive wheel assembly at least one second drive wheel and an actuator assembly, where the actuator assembly is arranged and configured to displace the at least one second drive wheel between a first position in which the at least one second drive wheel does not extend through the at least one second drive slot, and a second position in which in which at least a portion of the at least one second drive wheel extends through the at least one second drive slot into the housing chamber; wherein with the pile upper end within the housing chamber, arranging the drop plate assembly between the pile upper end and the hammer member;

arranging the engaging location relative to the drop plate assembly such that when the pile upper end a first distance within the housing chamber and the drive wheel is in the second position, the pile upper end is below the engaging location, and when the pile upper end a second distance within the housing chamber, the pile upper end is at the engaging location; and when the pile upper end is at the engaging location and the drive wheel is in the second position, operating of the first drive motor to rotate the first drive wheel such that the first and second drive wheels engage the hammer member such that the hammer member is lifted relative to the housing member.

10. The method as recited in claim 9, in which:

the step of providing the drive system further comprises the step of providing a second drive motor; and the second drive motor is operated to rotate the second drive wheel such that the first and second drive wheels engage the hammer member to lift the hammer member relative to the housing member.

11. The method as recited in claim 9, in which the step of providing the drop plate assembly comprises the step of providing a drop plate defining:

an impact portion at least partly arranged within the housing chamber; and at least one guide portion at least partly arranged within one of the at least one plate slots formed in the housing chamber.

12. A drop hammer pile driving system for driving a pile defining a pile upper end, the drop hammer pile driving system comprising:

a housing assembly comprising a housing member defining a housing chamber, a pile opening, at least one plate slot, at least one first drive slot, and at least one second drive slot, where the at least one first drive slot and the at least one second drive slot define an engaging location relative to the housing assembly, and a drop plate assembly comprising a drop plate defining an impact portion and at least one guide portion, where the impact portion of the drop plate assembly is arranged within the housing chamber, and the at least one guide portion of the drop plate assembly is arranged within the at least one plate slot to limit movement of the drop plate assembly relative to the housing member;

a hammer member arranged within the housing chamber for movement relative to the housing member and the drop plate assembly; and a drive system comprising a first drive wheel assembly comprising at least one first drive wheel and a first drive motor, where the at least one first drive wheel is arranged to extend into the at least one first drive slot, and a second drive wheel assembly at least one second drive wheel and an actuator assembly, where the actuator assembly is arranged and configured to displace the at least one second drive wheel between a first position in which the at least one second drive wheel does not extend through the at least one second drive slot, and a second position in which in which at least a portion of the at least one second drive wheel extends through the at least one second drive slot into the housing chamber; wherein with the pile upper end within the housing chamber, the drop plate assembly is arranged between the pile upper end and the hammer member; and the engaging location is arranged relative to the drop plate assembly such that when the pile upper end a first distance within the housing chamber and the drive wheel is in the second position, the pile upper end is below the engaging location, and when the pile upper end a second distance within the housing chamber, the pile upper end is at the engaging location; and when the pile upper end is at the engaging location and the drive wheel is in the second position, operation of the first drive motor rotates the first drive wheel such that the first and second drive wheels engage the hammer member such that the hammer member is lifted relative to the housing member.

13. The drop hammer pile driving system as recited in claim 12, in which the second drive wheel assembly further comprises a second drive motor, where operation of the second drive motor rotates the second drive wheel such that the first and second drive wheels engage the hammer member to lift the hammer member relative to the housing member.

14. The drop hammer pile driving system as recited in claim 12, in which the first drive wheel assembly further comprises a first axle member for supporting the first drive wheel for rotation relative to the housing assembly.

15. The drop hammer pile driving system as recited in claim 13, in which the second drive wheel assembly further comprises a second axle member for supporting the second drive wheel for rotation relative to the housing assembly.

16. The drop hammer pile driving system as recited in claim 12, in which the drop plate assembly further comprises at least one hammer bumper configured to engage the hammer.

17. The drop hammer pile driving system as recited in claim 12, in which the drop plate assembly further comprises at least one housing bumper configured to engage the housing.

18. The drop hammer pile driving system as recited in claim 12, in which the drop plate assembly further comprises:

at least one hammer bumper configured to engage the hammer; and at least one housing bumper configured to engage the housing.

* * * * *